US005129454A

United States Patent [19]

Telfer

[11] Patent Number: 5,129,454

[45] Date of Patent: Jul. 14, 1992

[54] MULTI-STRING PACKERS

[75] Inventor: George Telfer, Aberdeen, United Kingdom

[73] Assignee: Nodeco Limited, Aberdeen, United Kingdom

[21] Appl. No.: 612,531

[22] Filed: Nov. 13, 1990

[30] Foreign Application Priority Data

Dec. 5, 1989 [GB] United Kingdom ..... 8927478
Mar. 8, 1990 [GB] United Kingdom ..... 9005213

[51] Int. Cl.[5] ..... E21B 23/00

[52] U.S. Cl. ..... 166/120; 166/134; 166/189

[58] Field of Search ..... 166/387, 120, 134, 137, 166/189

[56] References Cited

U.S. PATENT DOCUMENTS

| | | | |
|---|---|---|---|
| 4,505,332 | 3/1985 | Mills et al. | 166/120 |
| 4,657,084 | 4/1987 | Evans | 166/120 X |
| 4,754,812 | 7/1988 | Gentry | 166/134 X |
| 4,930,573 | 6/1990 | Lane et al. | 166/189 X |

FOREIGN PATENT DOCUMENTS

| | | |
|---|---|---|
| 1012773 | 4/1963 | United Kingdom . |
| 2128660 | 5/1984 | United Kingdom . |
| 2138868 | 10/1984 | United Kingdom . |
| 2180572 | 4/1987 | United Kingdom . |
| 2202878 | 10/1988 | United Kingdom . |

*Primary Examiner*—William P. Neuder

*Attorney, Agent, or Firm*—Ratner & Prestia

[57] ABSTRACT

A multi-string packer for anchoring two or more non-concentric through tubes inside a larger pipe or casing (e.g. in an oil well). The packer can be deployed downhole, set, unset, and reset at least once without being withdrawn to the surface, despite the shearing of shear elements on each such operation. A lost-motion mechanism isolates the shear elements for the first packer resetting (the second setting) from packer-setting shear forces applied to the shear elements for the first packer setting, to preserve the second setting shear elements until the packer is actually required to be set for a second time. Similarly, another lost-motion mechanism isolates to shear elements for the second packer unsetting from the packer-unsetting shear forces applied to the shear elements for the first packet unsetting, to preserve the second unsetting shear elements until the packer is actually required to be unset for a second time.

As applied to a pump packer for use with a downhole electric pump, the invention enables the pump cable and completion string to be anchored and sealed inside the well casing. In the event of a wellhead fault necessitating unsetting of the packer, the string need only be withdrawn a short distance to access the wellhead fault for its repair, and then returned downhole that short distance only, since the packer can be reset at least once without being withdrawn to the surface. This avoids the need to withdraw the entire string to refurbish the packer for a second setting.

16 Claims, 29 Drawing Sheets

MULTI-STRING PACKERS

This invention relates to multi-string packers.

BACKGROUND OF THE INVENTION

In oil and gas wells, it is known to employ packers to seal the gap between the outside diameter of a smaller pipe and the inside diameter of a larger pipe or casing. Packers can also be employed to anchor the smaller pipe to the larger pipe in order to prevent relative axial movement between the two pipes. On occasion, two smaller diameter non-concentric pipes or strings have to be anchored and sealed off inside a larger pipe; the multi-string packer used for this operation is commonly referred to as a "dual packer".

In oil wells where downhole electric pumps are used to pump the oil to the surface, a dual packer is commonly used where one of the pipes running through the packer is used to carry the oil flow and the other pipe is used to seal off around an electrical penetrator which carries electric power to the pump motor.

Packers used in downhole pumping applications may also have one or more additional small diameter pipes running through them for the purposes of gas venting, pressure sensing, or chemical injection. Such downhole pumping packers are usually of a type which can be generally described as "hydraulic set, straight pull release pump packers". This type of packer has a major disadvantage which is that once the packer is unset, it cannot be reset without first being withdrawn from the well and refurbished (e.g. by the replacement of fractured shear pins). Thus any electrical or other problem at the wellhead necessitating raising of the string (attached through completion tubing to the packer and to the pump which delivers through the completion tubing) in turn requires that the packer be unset and the entire completion tubing withdrawn from the well in order to refurbish the packer for a further setting. Since the completion tubing may have a length of about 10,000 feet (3 Kilometers), non-resettability of the pump packer is clearly a grave disadvantage. On the other hand, if the pump packer were resettable without having to be withdrawn from the well, the completion tubing need only be pulled back by about 50 feet (15 meters) to allow access to the wellhead equipment for repairs, followed by re-running of the 50 feet (15 meters) of tubing to return the packer to setting depth, and resetting of the packer. Thus a resettable pump packer would avoid the need for pulling of more than a minimal length of tubing and hence give very substantial savings in time and cost.

Resettability of multi-string packers in non-pump applications can similarly give rise to greater convenience of use and improvement in financial economy.

It is therefore an object of the invention to provide a multi-string packer which can be set downhole, unset, and reset at least once without withdrawal.

SUMMARY OF THE INVENTION

According to the present invention there is provided a multi-string packer which is resettable at least once without being withdrawn from a well, said packer comprising a first through tube and at least one further through tube, slips for setting the packer by anchoring the packer to the inside diameter of a larger pipe or casing, slip actuator means for selectively either laterally advancing the slips to packer-anchoring laterally extended positions in which the packer is set or permitting the slips to retract laterally to non-anchoring laterally retracted positions in which the packer is unset, said slip actuator means being hydraulically actuable on a first occasion by shearing of first shear means to advance the slips laterally to the packer-anchoring laterally extended positions for a first setting of the packer upon such hydraulic actuation, said slip actuator means being subsequently mechanically or hydraulically actuable on a second occasion by shearing of second shear means to permit the slips to retract laterally to non-anchoring laterally retracted positions for a first unsetting of the packer upon such mechanical or hydraulic actuation, and said slip actuator means being subsequently hydraulically actuable on a third occasion by shearing of third shear means to re-advance the slips laterally to packer-anchoring laterally extended positions for a first resetting of the packer, said packer comprising first lost-motion means through which shearing of said third shear means upon said third occasion is accomplished, said first lost-motion means preventing shearing of said third shear means upon said first occasion.

Said packer preferably comprises a peripheral seal which is laterally expandable concomitantly with said hydraulic actuation of said slip actuator means on said first and third occasions such as to provide substantially pressure-tight sealing of the packer to the inside diameter of the larger pipe or casing. Said peripheral seal is preferably also contractible out of contact with the inside diameter of the larger pipe or casing concomitantly with said mechanical or hydraulic actuation of said slip actuator means on said second occasion.

Said packer preferably comprises a hydraulic piston movable under hydraulic pressure to cause said hydraulic actuation of said slip actuator means. Said hydraulic piston is preferably movable in a hydraulic cylinder comprised in said packer, said hydraulic cylinder preferably communicating by way of a passage to the interior of said first through tube whereby hydraulic pressurisation of said first through tube causes said hydraulic actuation of said slip actuator means on said first and third occasions.

Where said packer comprises a hydraulic piston running in a hydraulic cylinder and functioning to cause said hydraulic actuation of the slip actuator means on said first and third occasions, said packer is preferably such that said first shear means comprises at least one shear element directly linking said piston with said cylinder until said first occasion, and said third shear means comprises at least one shear element which is directly attached to said hydraulic cylinder to depend into a longitudinal slot in said hydraulic piston, said longitudinal slot being comprised in said first lost-motion means and having a length generally defining the extent of lost motion of said first lost-motion means.

Said packer is preferably such that said slip actuator means is mechanically coupled to said first through tube such that a substantial lift force applied to said first through tube causes said mechanical actuation of said slip actuator means on said second occasion, and said second shear means links said first through tube to said slip actuator means such that said substantial lift force shears said second shear means on said second occasion.

Said packer preferably further comprises a fourth shear means, and said packer is preferably such that said slip actuator means are subsequently mechanically or hydraulically actuable on a fourth occasion by shearing of said fourth shear means to permit the slips to retract laterally to non-anchoring laterally retracted positions for a second unsetting of the packer, with said packer further comprising second lost-motion means through which shearing of said fourth shear means upon said fourth occasion is accomplished, said second lost-motion means preventing shearing of said fourth shear means upon said second occasion.

Said second lost-motion means preferably comprises spring-biased slide means initially anchored at a first end through said second shear means to said first through tube and initially anchored at a second end through said fourth shear means to said first through tube, the initial anchored locations of said first and second ends being mutually separated along said first through tube and the spring biasing of said slide means being such as to tend to reduce the initial separation of said first and second ends, said second lost-motion means being such that shearing of said second shear means on said second occasion releases said first end of said spring-biased slide means for movement by said spring bias to abut said second end of said spring-biased slide means and render said fourth shear means shearable on said fourth occasion, the extent of movement of said first end from its initially anchored position to abutment with said second end generally constituting the lost motion of said second lost-motion means.

Said spring-biased slide means preferably incorporates latch means effective upon abutment of said first end with said second end to latch said first end in abutment with said second end. Said latch means may comprise a ratcheting collet.

Said movement of said first end of said spring-biased slide means by said spring bias is preferably damped by a hydraulic dash-pot comprised within said packer, and an elastomeric shock absorber is preferably interposed between said first and second ends.

BRIEF DESCRIPTION OF THE DRAWINGS

Embodiments of the invention will now be described by way of example, with reference to the accompanying drawings wherein.

DESCRIPTION OF PREFERRED EMBODIMENTS

Figure 1:
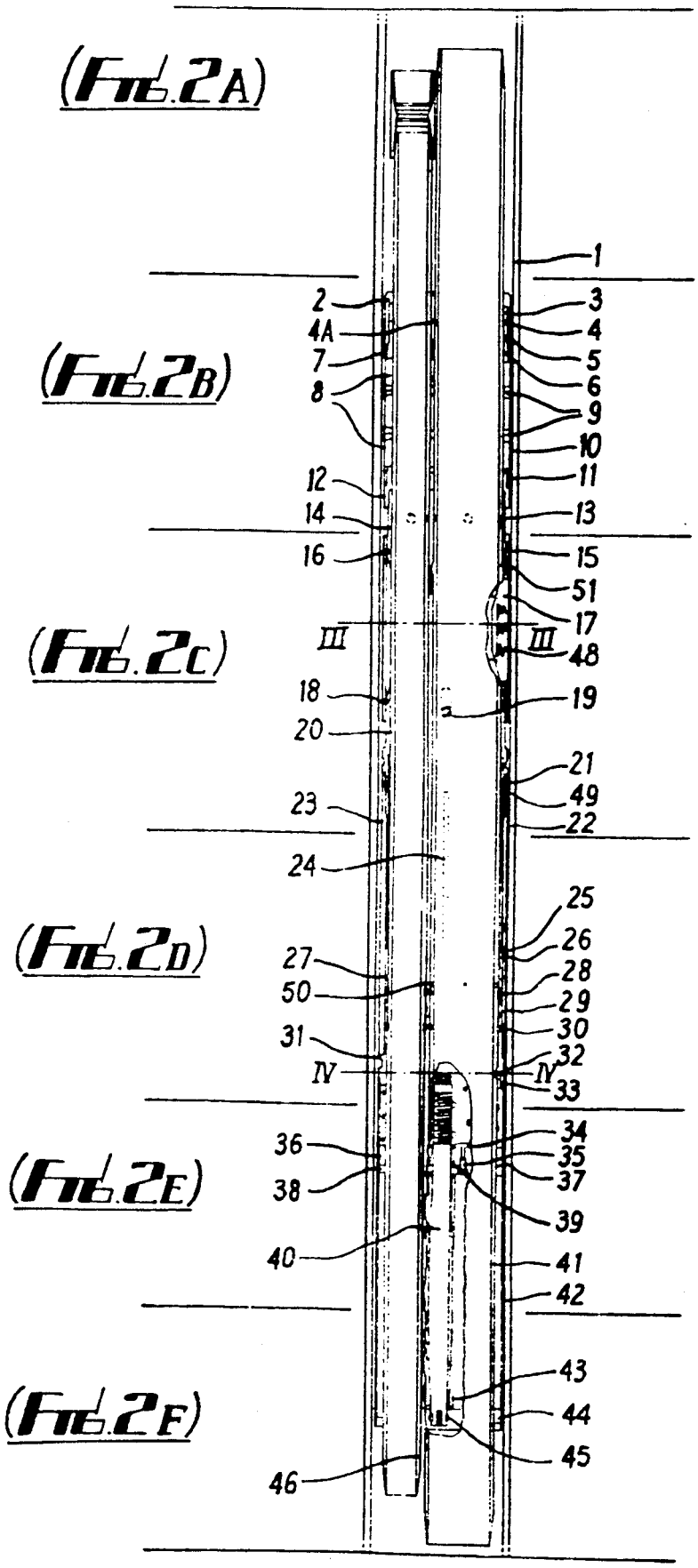
FIG. 1 is a sectional elevation of a first embodiment of multi-string packer in accordance with the invention, together with indicia of the sub-division of FIG. 1 to form the components of FIG. 2.

The first, second, third, and fourth exemplary embodiments of a multi-string packer in accordance with the present invention are described in the context of an arrangement in which the casing has a nominal outside diameter of 9.625 inches (244.5 millimeters) and an inside diameter of about 8.5 inches (215.9 millimeters), the main mandrel has an external diameter of 4.5 inches (114.3 millimeters) and an internal diameter of 3.937 inches (100.0 millimeters), while the or each penetrator-passing short string mandrel has an internal diameter of 2.047 inches (52.0 millimeters).

Figure 2A:
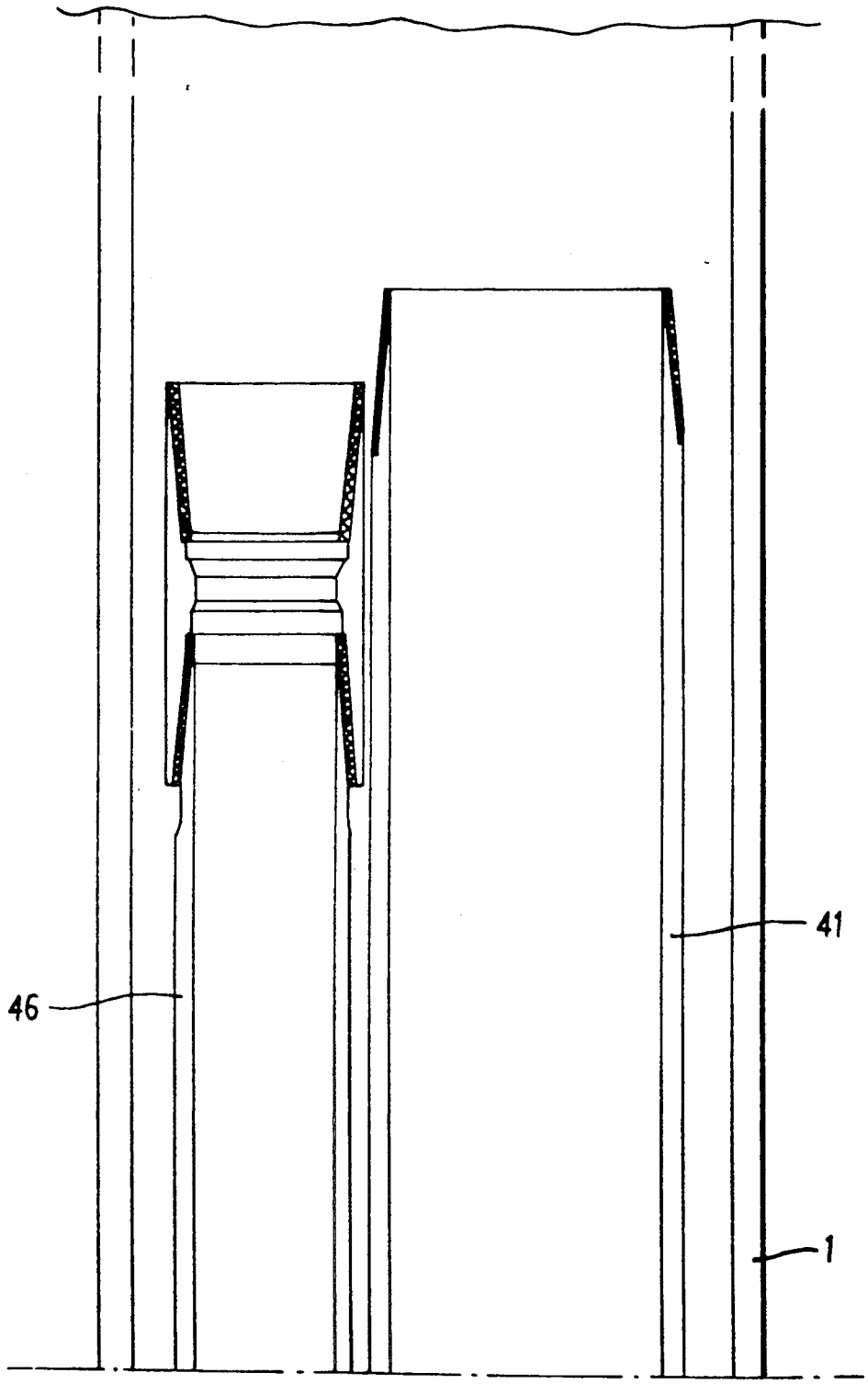
FIGS. 2A-2F are sub-divisions of FIG. 1, to a greatly enlarged scale and mutually fitting together as indicated in FIG. 1.
Figure 2B:
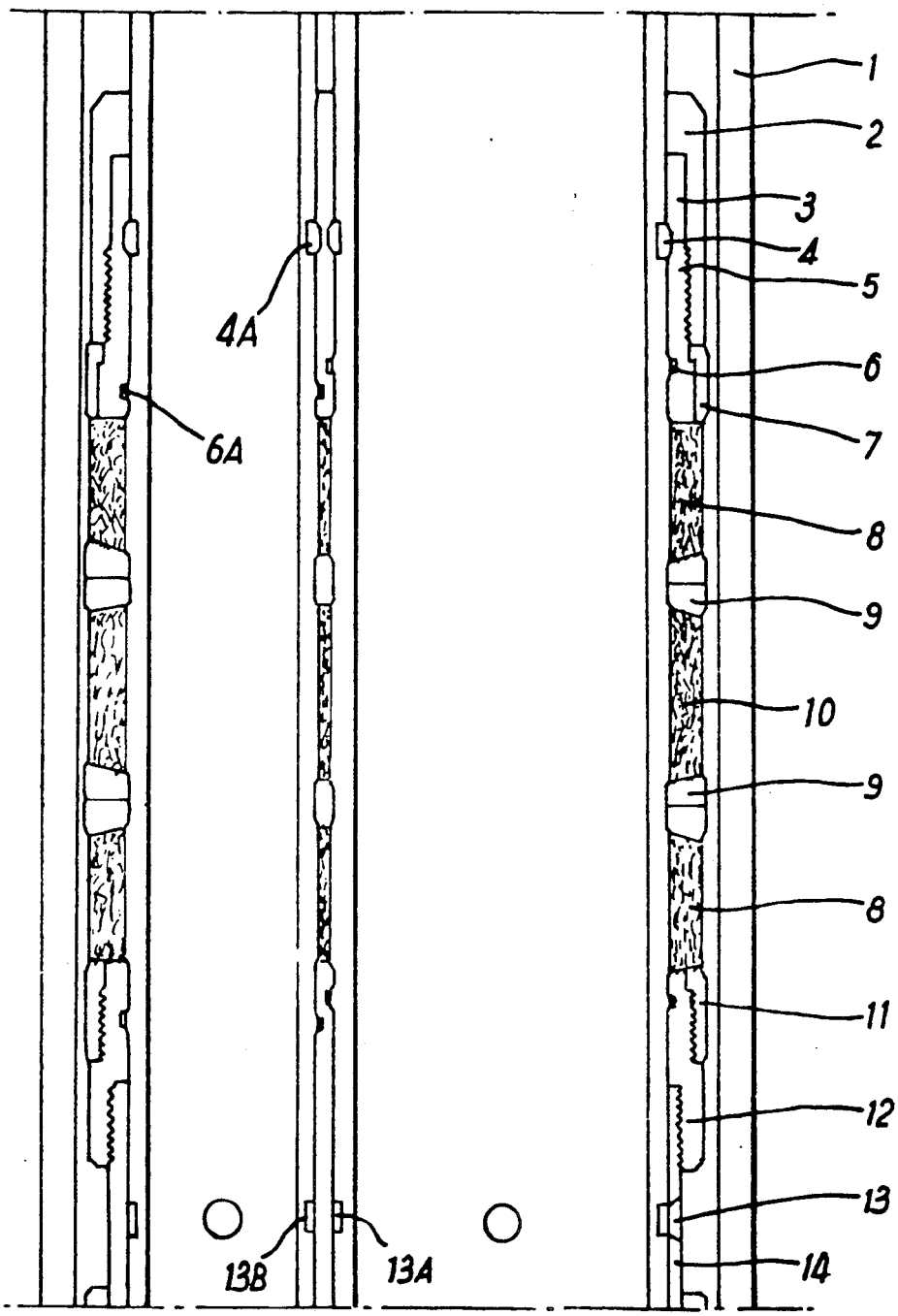
Figure 2C:
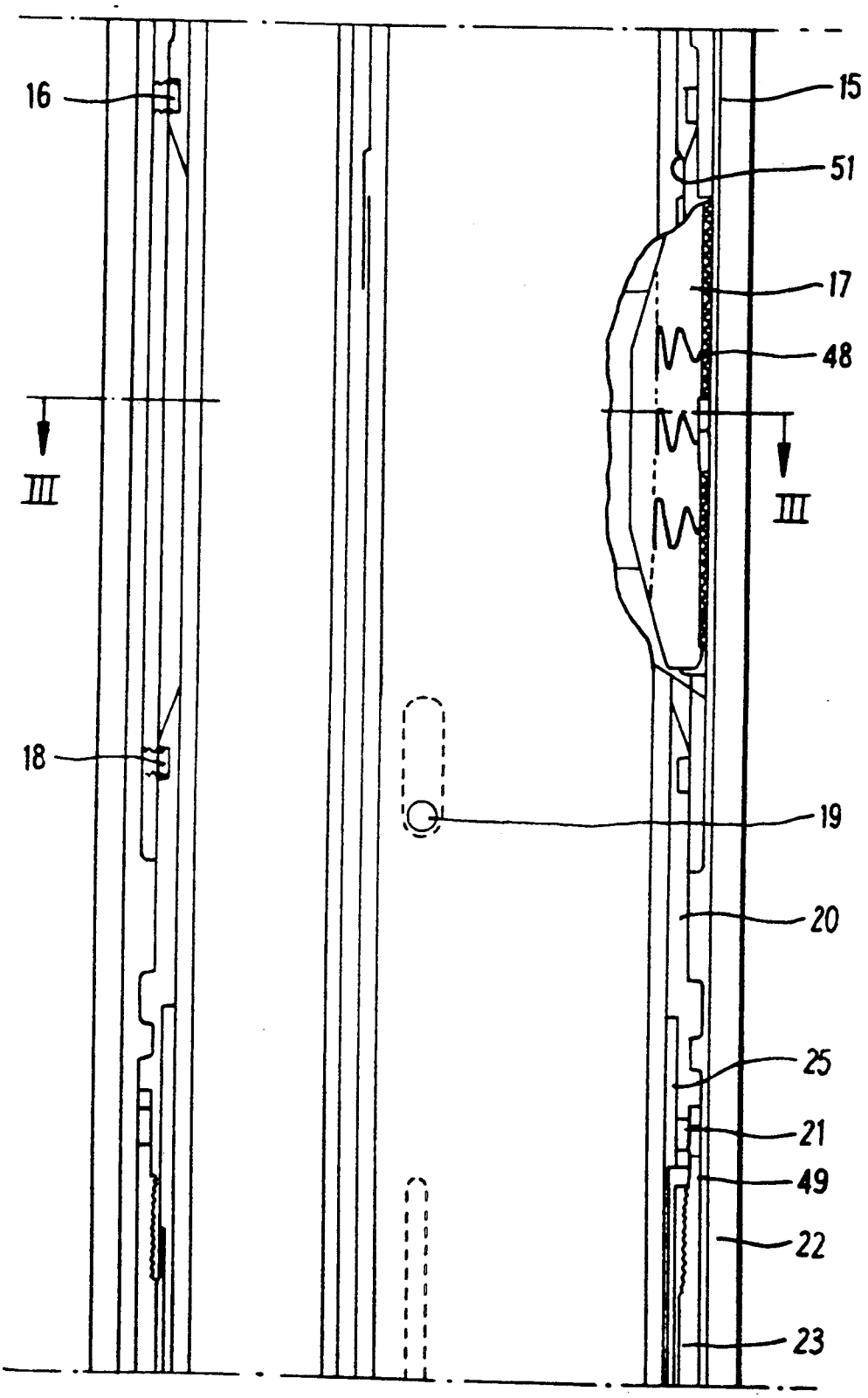
Figure 2D:
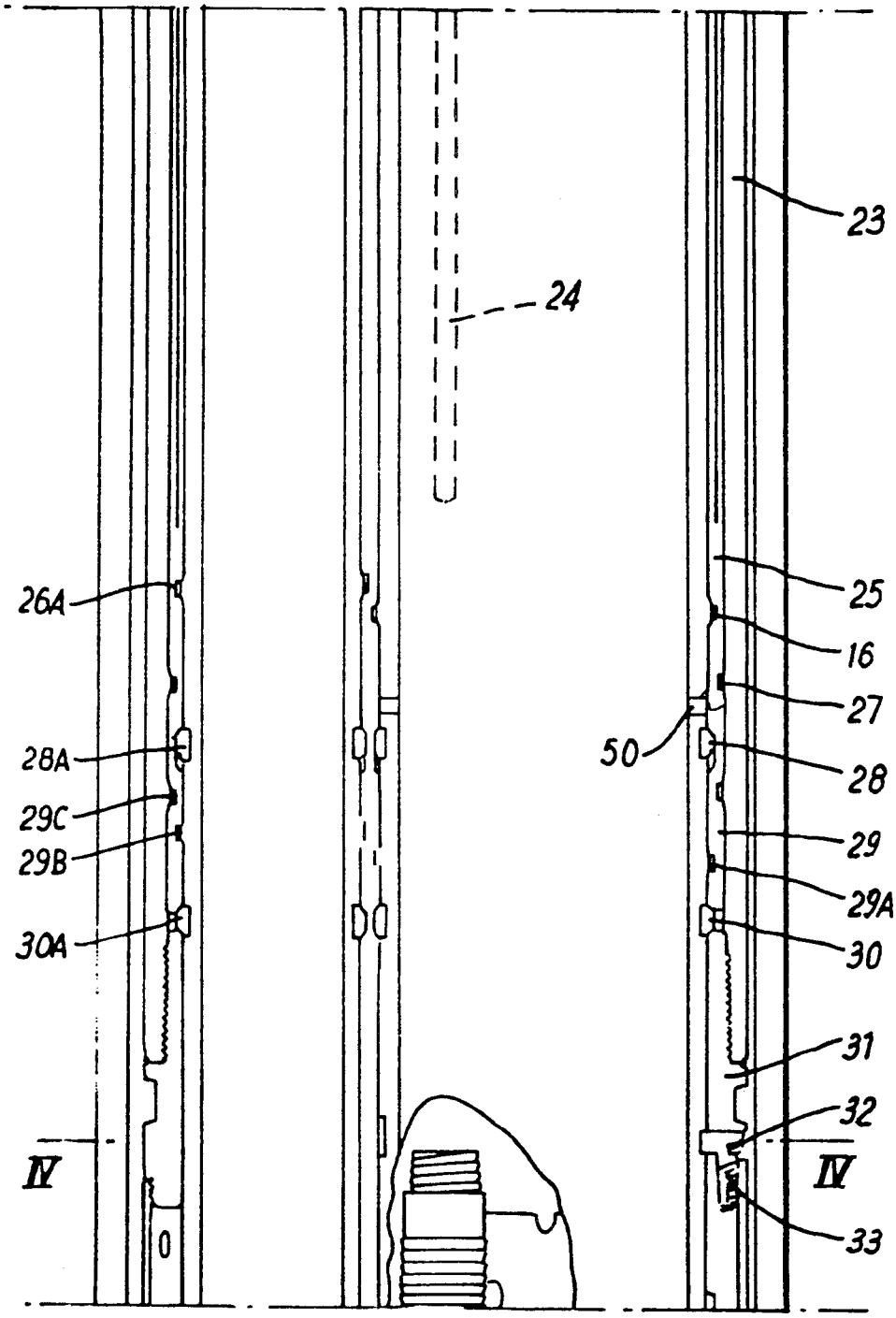
Figure 2E:
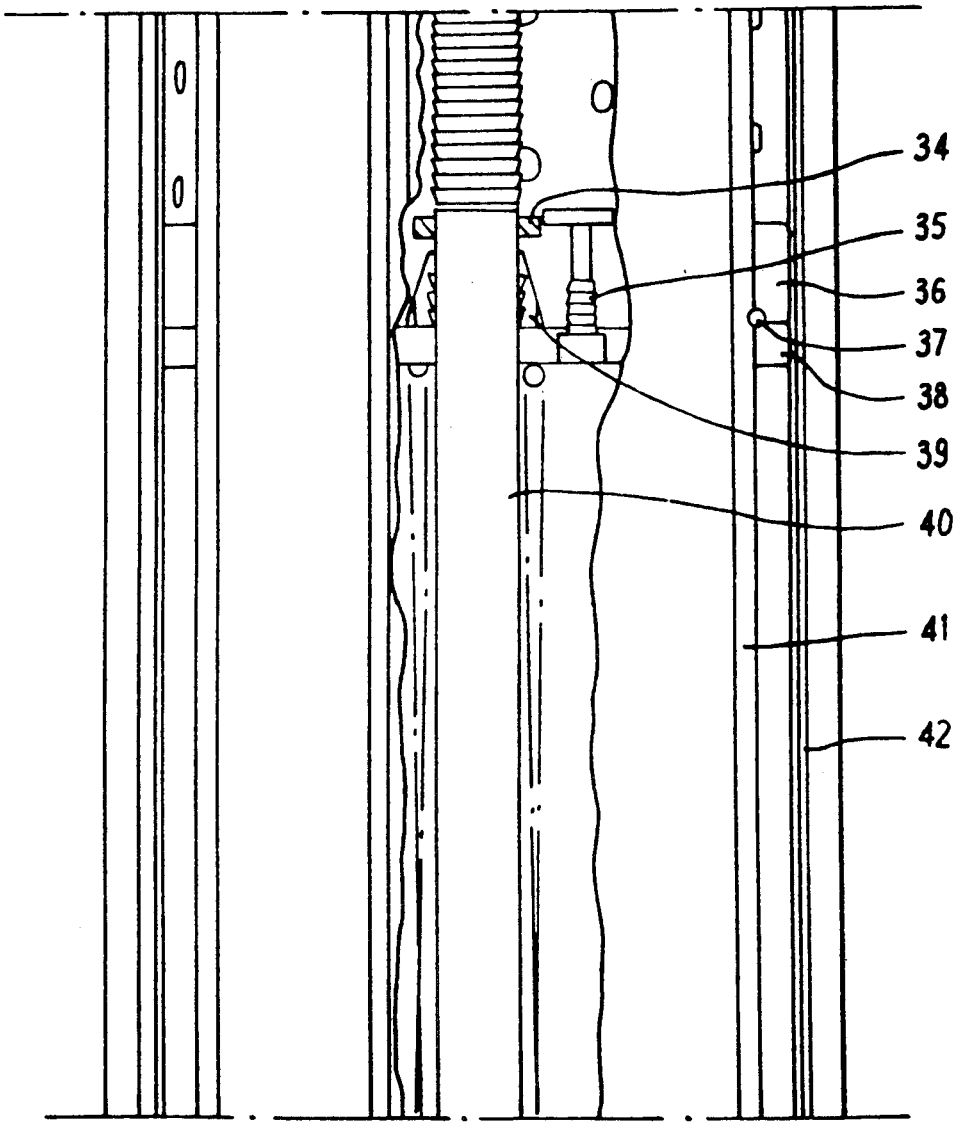
Figure 2F:
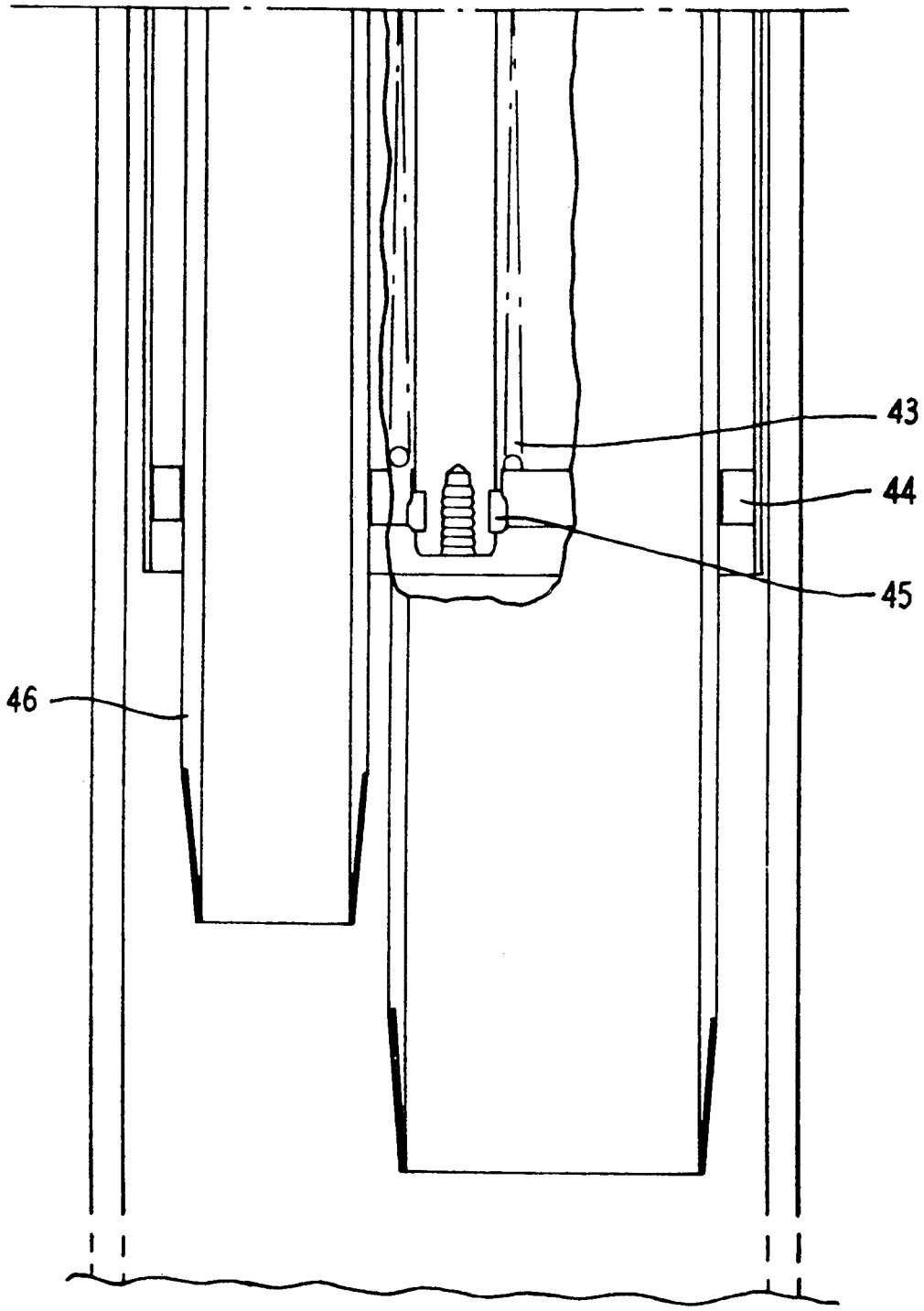
Figure 3:
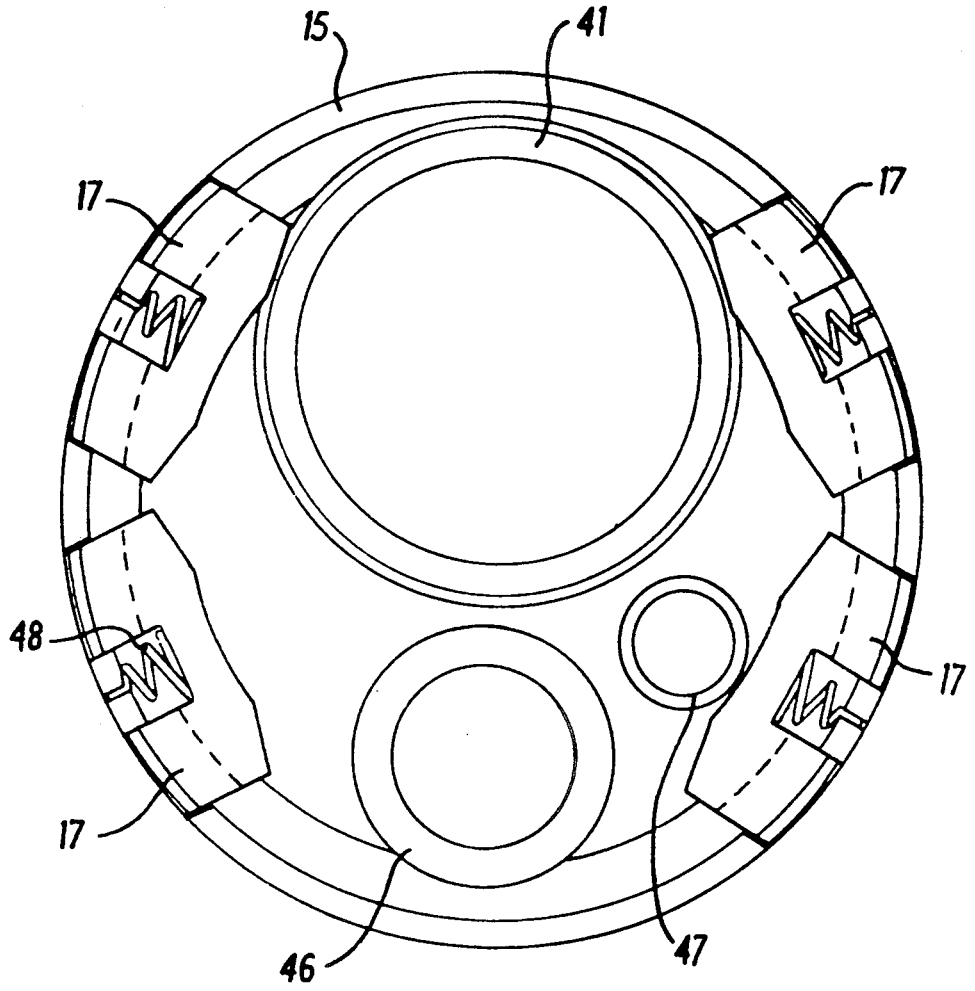
FIG. 3 is a transverse cross-section of the packer of FIG. 2, taken on the line III—III.
Figure 4:
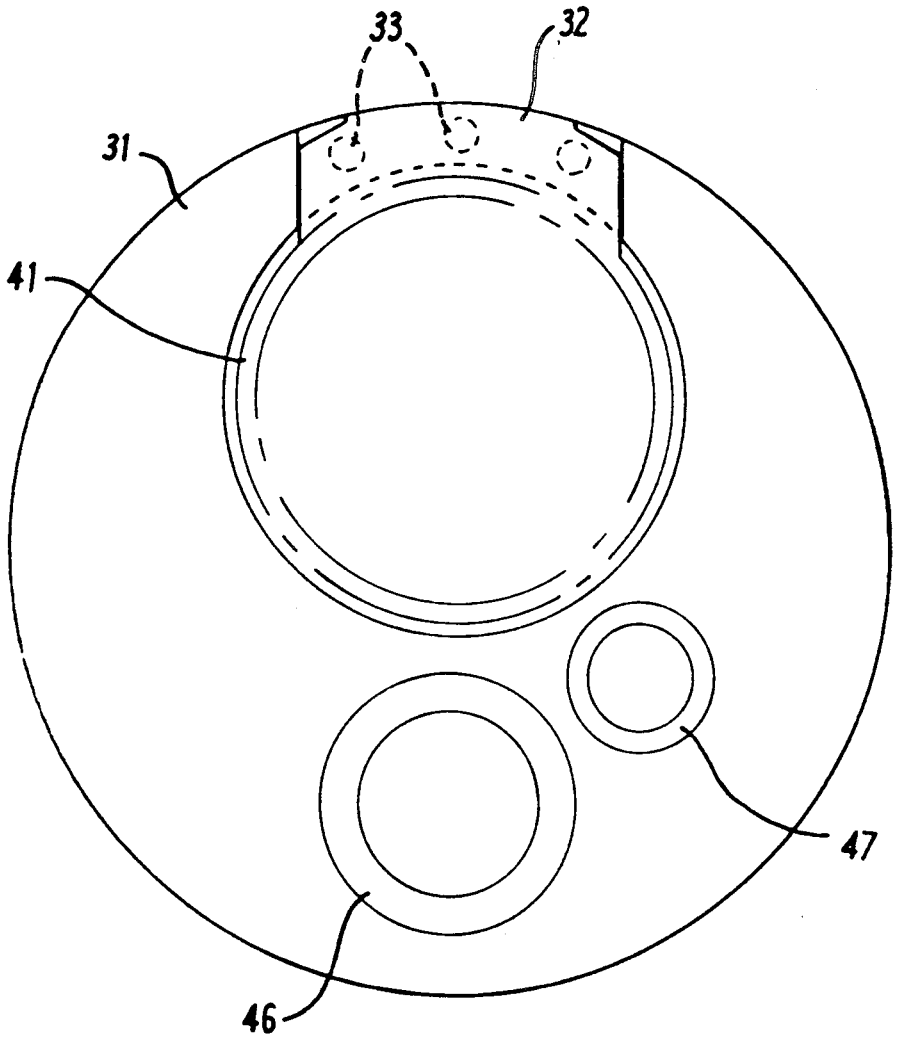
FIG. 4 is a transverse cross-section of the packer of FIG. 2, taken on the line IV—IV.

Referring first to FIGS. 1 to 4 of the drawings, an already-drilled oil well is lined with casing 1 (not shown in FIGS. 3 or 4). In order to produce from the cased-in well, an electrically-powered pump (not shown) is installed downhole, and coupled to deliver pumped oil upwell through completion tubing (not shown) whose outside diameter is substantially less than the inside diameter of the casing 1. The pump is installed below a packer (FIGS. 1 and 2) which forms a pressure-tight seal to the casing 1. The completion tubing is coupled through the packer by way of a main mandrel 41. Electric power for the pump is carried by an electrical penetrator (not shown) which passes through the packer by way of a short string mandrel 46 to which the penetrator is sealed.

The packer can be selectively sealed to casing 1 by three elements, comprising a middle packing element 10 separated by packing element spacers 9 from end packing elements 8. Above the upper one of the end packing elements 8 is an upper packing element ring 5 sealed around each of the mandrels 41 and 46 by O-rings 6 and 6A respectively. The ring 5 is in the form of a peripherally circular disc perforated by two eccentrically located holes respectively dimensioned to allow close passage to the mandrels 41 and 46. The upper packing element ring 5 is positively secured to the mandrels 41 and 46 by snap rings 4 and 4A fitted into external circumferential grooves on the mandrels 41 and 46, together with a retainer ring 3 and a screw-threaded top cap 2.

Below the lower one of the end packing elements 8 is a lower packing element ring 12 which is sealed around but not secured to the mandrels 41 and 46. The lower packing element ring 12 is screwed onto the upper end of an upper slip-setting cone 14 which will be detailed below.

A gauge ring 7 encircling the upper packing element ring 5 and a gauge ring 11 encircling the lower packing element ring 12 maintain the pressure sealing assembly out of direct contact with the inner surface of the casing 1 when the packing elements 8 and 10 are radially released by release of end compression.

The packer can be selectively anchored to the inside diameter of the casing 1 by means of slips 17 (FIGS. 2 and 3) which have substantially no free movement axially of the packer but which can move laterally with respect of the packer (radially with respect to the casing 1) so as either to advance to laterally extended positions bringing the slips 17 into anchoring contact with the casing 1 or retract laterally out of anchoring contact. The laterally outer faces of the slips 17 are toothed for maximum grip on the inner face of the casing 1. The slips 17 are loosely mounted in and generally located by a slips cage 15.

Concomitant mechanical anchoring and pressure sealing of the packer will now be detailed.

For remote downhole setting (anchoring) of the packer by means of hydraulic pressure applied at the surface, a blanking plug (not shown) is run down the completion tubing on a wireline to land on a nipple below the packer such that the interior of the completion tubing is sealed off except for radial ports 50 in the main mandrel 41. Hydraulic pressure is now applied at the surface to the interior of the completion tubing, and consequently to the interior of the main mandrel 41 running through the packer. This hydraulic pressure transmits through the ports 50 to the lower end of a main piston 25 which is slidingly mounted on the outer surfaces of the main mandrel 41 and of the short string mandrel 46. The outer surface of the lower end of the piston 25 slides within a static cylinder 23. The piston 25 slidingly seals around the mandrels 41, 46 and within the cylinder 23 by means of O-rings 26, 26A, and 27 respectively.

A secondary piston 29 forms a counter-piston to the main piston 25, and similarly encompasses the mandrels 41 and 46 while closely fitting within the cylinder 23. Axial movement of the secondary piston 29 relative to the mandrels 41 and 46 is prevented by respective pairs of snap rings 28 and 30, and 28A and 30A fitted into respective external circumferential grooves on the mandrels. O-rings 29A, 29B, and 29C seal the secondary piston 29 to the mandrels 41, 46 and to the cylinder 23 respectively.

The upper end of the piston 25 bears against the lower end of the lower slip-setting cone 20 which can act in conjunction with the upper slip-setting cone 14 to wedge the slips 17 to advance them laterally by axially compressing the pair of slip-setting cones 14 and 20 so as to move the cones 14 and 20 mutually towards one another. The lower slip-setting cone 20 is initially secured to the upper end of the cylinder 23 by a circumferential row of shear screws 21 and is also initially secured to the slips cage 15 by circumferentially distributed shear screws 18.

The upper slip-setting cone 14 is initially secured to the mandrels 41 and 46 by a series of shear screws 13 in the cone 14 projecting inwardly to engage in external circumferential slots 13A and 13B on the mandrels 41 and 46 respectively. The upper cone 14 is also initially secured to the slips cage 15 by circumferentially distributed shear screws 16.

The hydraulic pressurisation of the lower end of the piston 25 will force the piston 25 upwards within the cylinder 23, and at a given pressure, the shear screws 21 will part and release the lower slip-setting cone 20 for upward movement by the piston 25. In turn, this will shear the shear screws 18 initially joining the cone 20 to the slips cage 15, and then the shear screws 16 initially joining the slips cage 15 to the upper slip-setting cone 14.

The collective shearing of this group of shear elements 16, 18 and 21 allows the hydraulic pressurisation of the completion tubing to move the lower slip-setting cone 20 upwards, resulting in the lateral advance of the slips 17 to radially extended positions in which the slip 17 is firmly anchored to the inner diameter of the casing 1.

A further increase in pressurisation of the completion tubing will tend to move the piston 25 upwards, but such movement is blocked by the lower slip-setting cone 20 bearing against the now-immovable slips 17. However, the hydraulically-induced upward force on the piston 25 results in an equal downward force on the secondary piston or counter-piston 29. Since the piston 29 is secured against downward movement relative to the mandrels 41 and 46 by the snap rings 30, the hydraulically-induced downward force on the piston 29 results in the mandrels 41 and 46 being pulled downwards. Because the slips 17 are anchored to the casing 1, first the upper slip-setting cone 14 is pulled down to tighten the anchorage of the slips 17, next the shear screws 13 part to release the mandrels 41 and 46 from the now-immobile cone 14, and finally packer components above the slips 17 which are held up by the slips 17 but which are simultaneously being pulled or pushed downwards by mandrel tension transmitted through the snap rings 4 and 4A, are put in axial compression. This axial compression results in radial expansion of the elastomeric packing elements 8 and 10 into pressure-sealing contact with the inner diameter of the casing 1.

The packer is now fully set (mechanically anchored and pressure-sealed), and the annulus above the packer can be pressurised to test the adequacy of anchoring and the tightness of the seal to the casing. (If the packer required only to be mechanically anchored without also needing pressure-sealing to the casing, the packing elements 8 and 10, plus associated components, could be omitted).

For continued assurance of packer setting after the completion tubing is depressurised following the above-described setting operation, a ratchet-based mechanical locking system is employed and will now be described in detail.

An annular body lock ring 22 is secured by an external screw-thread of six threads per inch buttress left-hand form to corresponding threads on the inside of the cylinder 23, just below the upper rim of the cylinder 23. The body lock ring 22 also has a longitudinal cut to allow the location of an anti-rotation key-way 24 which inhibits relative rotation of the cylinder 23 and the piston 25. A pair of set screws 19 (only one being illustrated) in the cone 20 together with longitudinal slots in the slips cage 15 similarly inhibit relative rotation of the slips cage 15 and the lower slip-setting cone 20. The body lock ring 22 has a twelve threads per inch buttress left-hand thread form cut in its inside diameter for use as part of a ratchet mechanism in conjunction with a corresponding external thread form on the piston 25 (see below).

In the case of a packer dimensioned to fit a casing with a nominal outside diameter of 9.625 inches (245 millimeters) and an inside diameter of about 8.5 inches (about 218 millimeters), the main piston 25 has an overall length of 415 millimeters and a maximum outside diameter of 195 millimeters. From top to bottom the external configuration of the piston 25 is:

(a) a section 90 millimeters long and having a plain machined outside diameter of 192 millimeters;

(b) a section 255 millimeters long externally machined with twelve threads per inch buttress left hand thread form oppositely inclined to but otherwise matching the internal buttress thread form on the body lock ring 22 and whose function will be described below; and (c) a section 70 millimeters long having a plain machined outside diameter of 195 millimeters, with an external O-ring groove for carrying the O-ring 27 that slidingly seals the outside diameter of the piston 25 to the inside diameter of the cylinder 23.

In addition to the above-described external features, the piston 25 is cut near its upper end with six equiangularly spaced longitudinal slots which are each 6 millimeters deep, 13 millimeters wide, and 167 millimeters long. A circumferential row of shear screws 49 are set into the upper end of the cylinder 23, above the body lock ring 22 and below the initial position of the lower slip-setting cone 20 prior to the shearing of the shear screws 21. These shear screws 49 project radially inwardly of the cylinder 23 and into the above-mentioned longitudinal slots in the piston 25 to form a lost-motion mechanism, for a purpose to be detailed subsequently.

The mutually oppositely inclined buttress threads on the outside of the piston 25 and on the inside of the body lock ring 22 form a ratchet mechanism which allows the piston 25 to move relatively freely upwards through the lock ring 22 (the above-mentioned longitudinal cut in the lock ring 22 permitting its circumferential expansion for such movement down the piston 25), but which prevents reverse movement of the piston 25 back down through the lock ring 22 when the piston 25 is depressurised after setting of the packer. (These threads also allow the piston 25 to be unscrewed from the body lock ring 22 when the packer has been unset and retrieved to the surface, such that the packer can be refurbished for a further deployment and use down-well).

The ability of the packer to be subsequently unset and later reset despite the irreversibility of the piston 25 is explained below.

Details of the structure and function of the parts of the packer relevant to the first unsetting of the packer will now be described.

The lower end of the cylinder 23 is secured by a screw-threaded connection to a cylinder end member 31 which is slidingly mounted on the mandrels 41 and 46. The member 31 also serves as a shear plate retainer ring for a shear plate 32 (FIGS. 2D and 4) which is housed in a transverse notch in the member 31 and projects into an external circumferential groove on the mandrel 41. Set screws 33 (of which only one is visible in FIG. 2D) retain the shear plate 32 in the member 31.

Two parallel primer rods 40 (of which only one is visible in FIGS. 2D-2F) are attached at their upper ends to the underside of the cylinder end member 31, and depend to the lower end of the packer. A retainer plate 44 is secured to the lower ends of the primer rods 40 by snap rings 45. Intermediate the ends of the primer rods 40 is a slidably mounted assembly comprising a shear ring retainer plate 36, an adjacent lock ring retainer plate 38, and an intermediate shear ring 37 by which this assembly is initially secured to the mandrel 41, the shear ring 37 lying partly sandwiched between the adjacent plates 36 and 38, and partly in an external circumferential groove formed in the mandrel 41. Retainer bolts 37 mutually secure the plate 36 and 38 to hold the assembly together. Circumferentially split lock rings 39 with conical exteriors and internal ratchet surfaces are also sandwiched between the plates 36 and 38 to circumscribe the two primer rods 40. The upper end of each primer rod 40 is formed with a buttress thread with which the lock rings 39 interact in the manner of ratcheting collets to allow the plates 36 and 38 to move in one direction only (upwards) relative to the primer rods 40, following shearing of the shear ring 37 in circumstances which will be detailed below.

A heavy-duty high-rate compression spring 43 surrounds each primer rod 40 and is kept in compression between the plates 38 and 44 until such time as the shear ring 37 is sheared. (The initial compression of the springs 43 is set prior to the first deployment of the packer from the surface to its downhole setting location). When the shear ring 37 is sheared, the springs 43 push the plates 36 and 38 up towards the cylinder end member 31 in which the upper ends of the primer rods 40 are anchored. The rate of approach of the plate 36 to the member is damped by surrounding the plate assembly with a sleeve 42 secured to the bottom end of the cylinder end member 31, perforations in the sleeve 42 causing this arrangement to function as a hydraulic dash-pot in conjunction with well fluids in which at least the lower end of the packer will normally be immersed. Impact of the plate 36 against the member 31 is minimised by fitting the upper surface of the plate 36 with rubber shock absorbers 34 encircling the rods 40 and standing proud of the plate 36 so as to take the first contact with the member 31.

When the packer is to be unset for the first time, the completion string is picked up, and a lift force is applied with a magnitude that results in a tension of 50,000 pounds being applied through the completion string to the packer mandrel 41. Since the slips 17 are firmly anchored to the casing 1, the uplift or tension in the mandrel 41 reacts through the shear plate 32, the combined cylinder end member and shear plate retainer 31, the cylinder 23, the body lock ring 22 and its internal ratchet surface, the piston 25 and its external ratchet surface, and the lower slip-setting cone 20 to the slips 17. The shear plate 32 is designed to shear under such tension (substantially above normal operational tension to avoid premature unsetting of the packer), and so release the locked-in setting forces. With the shear plate 32 broken, the mandrel 41 will move upwards relative to the majority of the remainder of the packer, until an external upset or shoulder 51 on the mandrel 41 catches under the upper cone 14 to lift the cone 14 away from the slips 17. Continued upward movement of the mandrel 41 relative to the majority of the remainder of the packer allows the end and middle packing elements 8 and 10 to contract radially, come out of sealing contact with the inner surface of the casing 1, and complete the relaxation of the packer. This occurs because the elastomeric packing elements 8 and 10 each retain a "memory" of their original shape, and the unset packer provides the original space for these packing elements to occupy. The internal compression springs 48 encourage fully retraction of the slips 17 radially inwards away from contact with the casing 1.

Simultaneously with the above-described relaxation and release of the packer anchoring and sealing, shearing of the shear plate 32 also allows the springs 43 to pull the cylinder end member 31 downwards into contact with the shear ring retainer plate 36 (the shear ring 37 remaining intact for the time being). The downward movement of the cylinder end member 31 results in equal downward movement of the cylinder 23, together with the body ring 22 and the ratchet-locked main piston 25.

At the conclusion of the above-described packer unsetting procedure, the packer can be raised by a distance sufficient to gain access to the faulty wellhead equipment whose failure has necessitated the first unsetting of the packer. However, since the packer can be reset at least once without refurbishment, the wellhead fault does not require the packer to be pulled all the way to the surface before resetting.

As an alternative to the above-described mechanical actuation of first-time packer unsetting, the packer may incorporate hydraulic means (not shown) by which hydraulic actuation of first-time packer unsetting may be achieved.

Once the wellhead fault is repaired, the completion string and the packer are lowered by the short distance necessary to return the packer to the intended setting depth. The resetting procedure is the same as described above in respect of the first setting procedure (with wireline-fitted plug and hydraulic pressurisation of the completion string), except that only the one set of shear screws 49 requires to be sheared on this occasion. The previously-described longitudinal slots in the piston 25 into which the shear screws 49 project have a length defining the lost motion of the lost-motion mechanism functionally constituted thereby, and which thereby keeps the shear screws 49 intact during the first setting of the packer but brings them upon the first upset into positions in which they are shearable for the first reset (the second setting). As the piston 25 is hydraulically forced upwards during the reset, the screws 49 are sheared between their fixed positions in the cylinder 23, and the lower ends of the longitudinal slots in the piston 25. The cylinder 23 is made sufficiently long to allow for the two cumulative strokes of the main piston 25 (one stroke for each setting, with ratchet prevention of reversal between strokes).

As an alternative to the direct mounting of the shear screws 49 in the cylinder 23 as illustrated in FIG. 2C, the screws 49 could be mounted in a separate ring (not shown in FIG. 2C, but see item 123A in FIG. 8C), with the screws 49 being screwed into this separate ring to project inwardly thereof. This separate ring would be located between the lower slip-setting cone 20 and the body lock ring 22. The ring would remain 'attached' to the cylinder 23 and have approximately the same outside and inside diameters as the body lock ring 22, but would not be attached to the lower cone 20, nor to the body lock ring 22, nor to the piston 25. This alternative arrangement is expected to allow a positive shear indication as the ring-mounted shear screws 49 are sheared when the packer is set for the second time.

When the packer is to be unset again following the second setting, the unsetting procedure employed is essentially the same as was used for the first unsetting, i.e. the completion string is picked up and a lift force of 70,000 pounds is applied. Bearing in mind that the cylinder end member 31 is concurrently in contact with the retainer plate 36, the 70,000 pound tension in the mandrel 41 shears the shear ring 37. This releases the locked-in setting forces in the same way as did shearing of the shear plate 32 during the first unsetting described above, and consequently the packer will unset as before, leaving it free to be pulled from the well.

The initial separation of the shear ring retainer plate 36 from the cylinder end member 31 which closes up upon shearing of the shear plate 32 represents the lost motion of the lost-motion mechanism constituted thereby, this mechanism keeping the shear ring 37 unsheared prior to the second unsetting and placing the packer components in a condition to apply shearing forces to the shear ring 37 subsequent to the first unsetting (but not prior thereto).

As an alternative to the above-described mechanical actuation of second-time packer unsetting, the packer may incorporate hydraulic means (not shown) by which hydraulic actuation of second-time packer unsetting may be achieved. The hydraulic means for hydraulically actuating second-time packer unsetting may be the same as or different from the previously suggested hydraulic means for hydraulically achieving first-time packer unsetting.

The series combinations of shear elements and lost-motion mechanisms can be compounded over the above-described arrangements so as to enable multiple resetting and unsetting of the packer without intervening refurbishments, i.e. setting and unsetting sequences numbering three or more.

While certain modifications and variations of the above embodiments have been described, the invention is not restricted thereto, and other modifications and variations can be adopted without departing from the scope of the invention. For example, besides the mandrels 41 and 46, the packer may comprise a third through tube 47 (shown in FIGS. 3 and 4 only) for use as a vent line.

Further possible modifications variations within the scope of the invention will now be detailed by way of a second exemplary and non-limiting embodiment of the present invention, and described below with reference to FIGS. 5 and 6.

Figure 5:
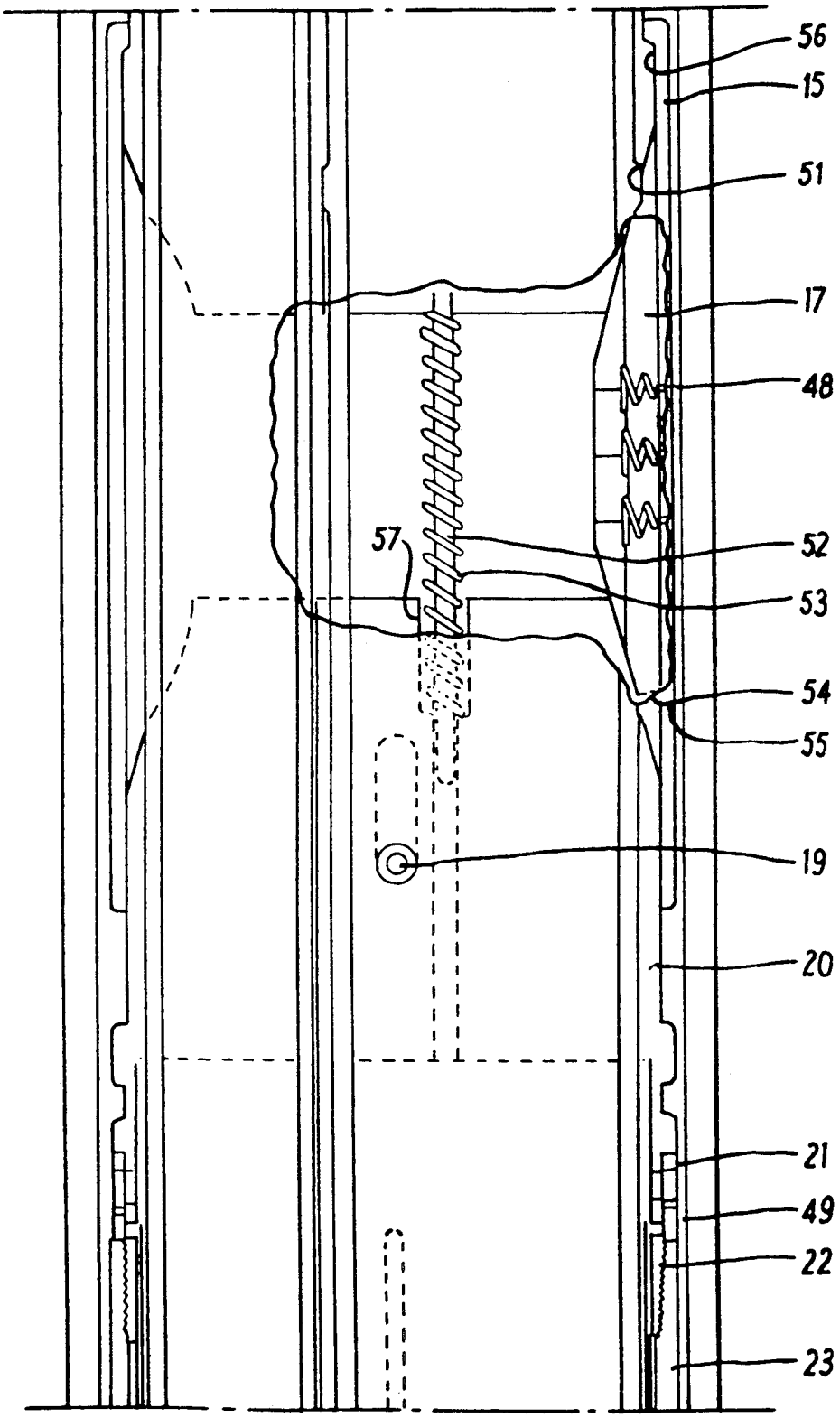
FIG. 5 is a sectional elevation of part of a second embodiment of multi-string packer in accordance with the invention, said part corresponding to the part of the first embodiment shown in FIG. 2C.

FIG. 5 is a sectional elevation of part of the second embodiment in the form of a single-penetrator pump packer which is essentially the same as the first embodiment shown in FIGS. 1 to 4, except for certain details shown in FIG. 5 which otherwise corresponds to FIG. 2C. FIG. 6 is a transverse cross-section of the packer of FIG. 5 taken on a line corresponding to the section line of FIG. 3, i.e.. horizontally through the slips 17 at approximately their mid-height.

Those parts of the second embodiment which are not structurally or functionally altered from corresponding parts of the first embodiment are given the same reference numerals. Accordingly, for a full description of any part of the second embodiment not detailed below, reference should be made to the above description of the corresponding part of the first embodiment. Since the second embodiment is largely the same as the first embodiment, the following description will concentrate mainly on the parts of the second embodiment which differ from the first embodiment.

Figure 6:
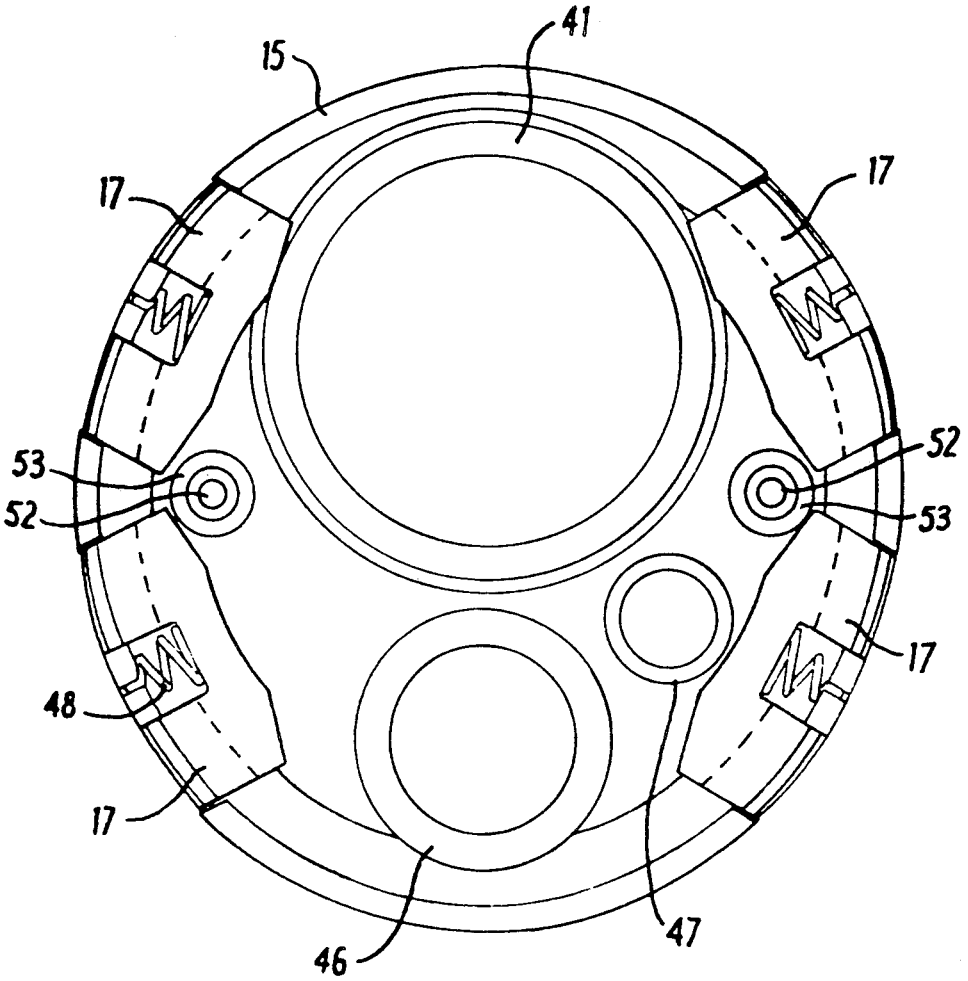
FIG. 6 is a transverse cross-section of the packer of FIG. 5 taken on a line corresponding to the section line of FIG. 3.

Compared to the first embodiment as partially illustrated in FIG. 2C, in the second embodiment as illustrated in FIGS. 5 and 6 the shear screws 16 and 18 are omitted, and two coiled compression springs 53 are added. The springs 53 extend between opposing faces of the upper and lower slip-setting cones 14 and 20. The springs 53 are held in place and are inhibited from lateral collapse by being slidingly mounted on respective rigid rods 52, and are further located by being recessed into respective holes 57 cut into the upper end of the lower slip-setting cone 20. The rods 52 are each secured at their upper ends by being screw-threaded into the lower end of the upper slip-setting cone 14. The lower ends of the rods 52 extend down into lesser-diameter downward extensions of the holes 57 such that while the upper ends of the rods 52 are fixed relative to the upper cone 14, the lower ends of the rods 52 can move longitudinally with respect to the lower cone 20 as the mutual separation of the cones 14 and 20 varies during slip-setting and slip-unsetting operations.

The shear screws 16 and 18 can be omitted from the second embodiment because the pair of set-screws 19 prevent the slips cage 15 from moving upwards and prematurely forcing the slips 17 into the casing 1 by too-early contact with the upper cone 14. Similarly, the lip (or internal shoulder) 56 at the upper end of the slips cage 15 prevents the slips cage 15 from moving downwards and prematurely forcing the slips 17 onto the lower slip-setting cone 20 and hence prematurely anchoring the slips 17 into the casing 1.

When the packer is assembled as shown in FIG. 5, the two springs 53 are each compressed by approximately one inch, which requires a compressive force of approximately 500 pounds. When the packer is set, the lower cone 20 and the upper cone 14 are forced towards each other in order to push the slips 17 radially outwards of the packer to anchor into the casing 1. This anchoring action further compresses the two springs 53.

During unsetting of the packer (whether mechanically actuated or hydraulically actuated), the two springs 53 will force the lower cone 20 downwards until the two set screws 19 are each at the bottom of the respective associated longitudinal slot in the slips cage 15. This action will allow the internal compression springs 48 to retract the slips 17 radially fully inwards away from contact with the casing 1, and hence unanchor the packer.

The lower end surface 54 of each of the four slips 17 is formed with a seventeen degree angle of taper longitudinally downwards and radially inwards. The lower edge surface 55 of each of the slip-accommodating windows in the slips cage 15 is formed with a corresponding seventeen degree angle of taper longitudinally downwards and radially inwards. This matching taper profiling of the surfaces 54 and 55 results in their mutual interaction during packer unsetting to help pull the slips 17 away from the casing 1. Thus, unlike the first embodiment of packer (FIGS. 1 to 4) in which the slips 17 are merely non-positively allowed to retract radially inwards from anchoring contact with the casing 1 under the radially inward bias of the springs 48, in the second embodiment of packer (FIGS. 5 and 6) there is an element of positive retraction of the slips 17 radially inwards from the casing 1.

In the second embodiment the arrangement of the springs 53 and of the mutually interactive slips/slips cage profiling of their respective surfaces 54 and 55 give superior performance (compared to the first embodiment) during packer unsetting in terms of ensuring that the packer can be retrieved from the well. This arrangement may therefore be considered to be essential (in a practical, though not absolute, sense) in a resettable pump packer, and to be highly desirable in a packer which is not intended to be reset but nevertheless ensures easier retrieval from the well following its first (and only) unsetting.

Referring now to FIGS. 7 to 12, these illustrate a third embodiment of multi-string packer in accordance with the present invention, this third embodiment being a single-penetrator pump packer which is, in essential respects, substantially the same as the second embodiment (FIGS. 5 to 6) which, in turn, is a modification of the first embodiment (FIGS. 1 to 4). Those parts of the third embodiment which are not structurally or functionally substantially different from corresponding parts of the first and second embodiments are given the same reference numerals, preceded by "1" (i.e. the corresponding reference numeral in FIGS. 1 to 6 plus "100"). Accordingly, for a full description of any part of the third embodiment not detailed below, reference should be made to the above description of the corresponding parts of the first and/or second embodiments. Since the third embodiment is largely the same as the second embodiment, and essentially similar to the first embodiment (with modifications), the following description of the third embodiment will concentrate mainly on those parts of the third embodiment which differ from the first and/or second embodiments.

Figure 7:
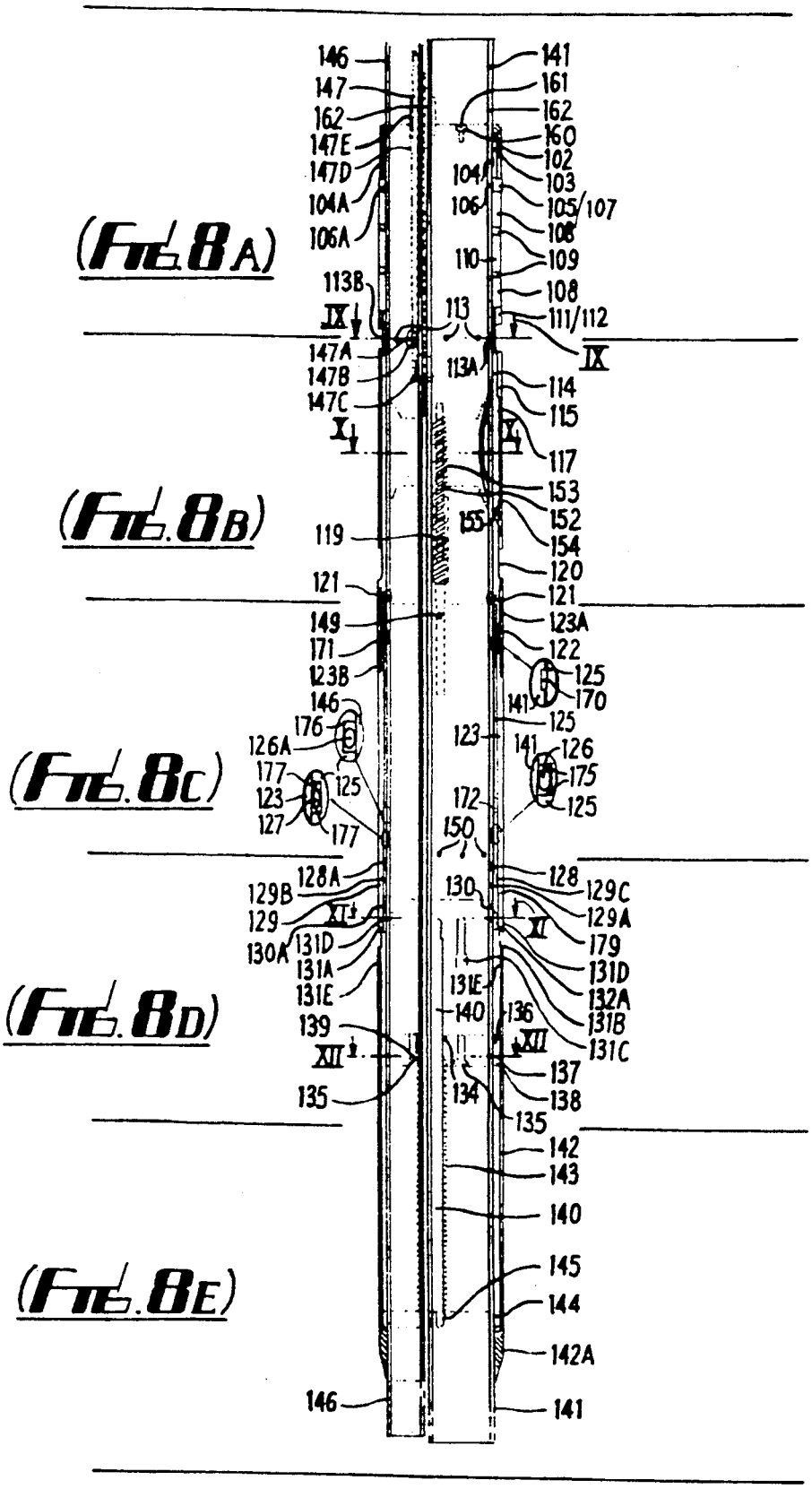
FIG. 7 is a sectional elevation of a third embodiment of a multi-string packer in accordance with the invention, together with indicia of the sub-division of FIG. 7 to form the components of FIG. 8.

In FIGS. 7 to 12, the casing 1 of FIGS. 1, 2 and 5 is omitted. FIG. 7 is the overall view of the third embodiment, and includes indicia of the sub-divisions of FIG. 7 to form the components of FIG. 8 (which are to a greatly enlarged scale with respect to FIG. 7).

Figure 8A:
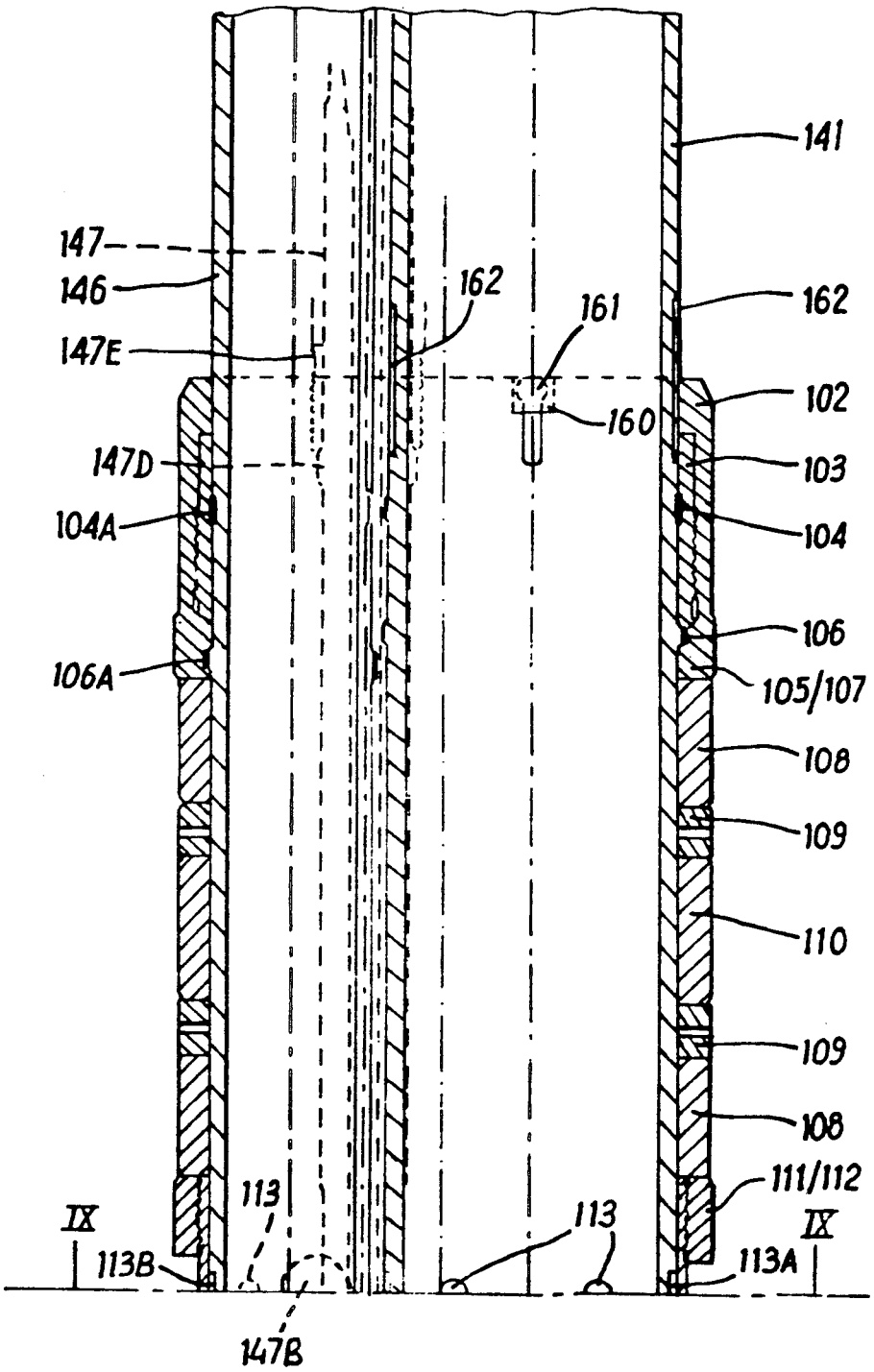
FIGS. 8A-8E are sub-divisions of FIG. 7, to a greatly enlarged scale and fitting together as shown in FIG. 7.
Figure 8B:
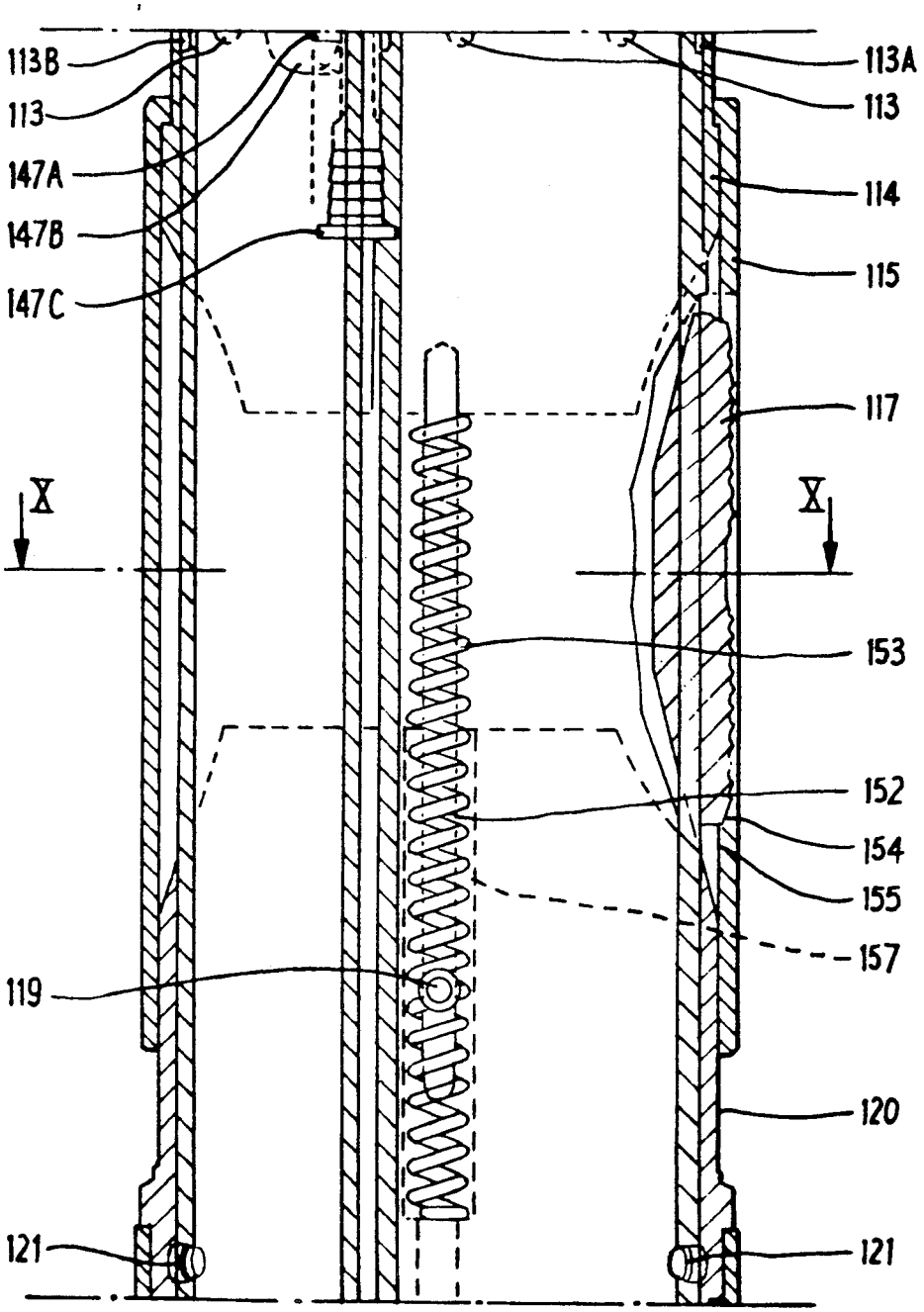

In the third embodiment, the vent line or pressure access line 147 (FIGS. 7 and 8A) extends downwards from the top of the packer to just below the lower packing element 108 where the line 147 is coupled to the exterior of the packer by a laterally extending port 147A (FIGS. 7, 8A, 8B, and 9) and a corresponding port 147B in the upper cone 114. The pressure line port 147A has a taper screw thread to enable the fitting of a temporary plug for pressure testing the line 147 prior to deployment and use of the packer. The lower end of the line 147 is closed in use of the packer by a screw-threaded plug 147C (FIGS. 7 and 8B). The line 147 is secured to the top cap 102 by means of a circumferential flange 147D (FIGS. 7 and 8A) clamped by a ring-form lock-nut or collar 147E secured into a screw-threaded aperture in the top cap 102. In use of the packer, the line 147 is connected by a suitable conduit (not shown) to the surface, and may be used to selectively vent the well below the packing elements 108 and 110, or connected to a pressure gauge to sense the pressure in the well below the packer.

The main mandrel 141 is locked against rotation relative to the top cap 102 by means of a pair of torque lock keys 160 (only one being visible in FIGS. 7 and 8A), each secured in a respective diametrally opposed matching recess in the top cap 102 by a respective socket-head cap screw 161. With respect to the axial centreline of the main mandrel 141, each of the keys 160 extends radially inwards of the circular aperture in the top cap 102 through which the mandrel 141 axially extends, such that the radially inner end of each of the keys 160 slidingly engages one of a diametrally opposed pair of four equally circumferentially spaced and axially extending slots or key-ways 162 formed in the outer surface of the mandrel 141, each slot or key-way 162 having a circumferential width around the outside of the mandrel 141 which is marginally greater than the width of the inner ends of the keys 160. Each of the four slots or key-ways 162 may have a length of about 55 millimetres and a width of about 17 millimetres, the length facilitating the placement of the keys 160 after the mandrel 141 has been fitted in the packer.

The packing element rings 105 and 112 are each combined with respective associated gauge rings 107 and 111.

Figure 10:
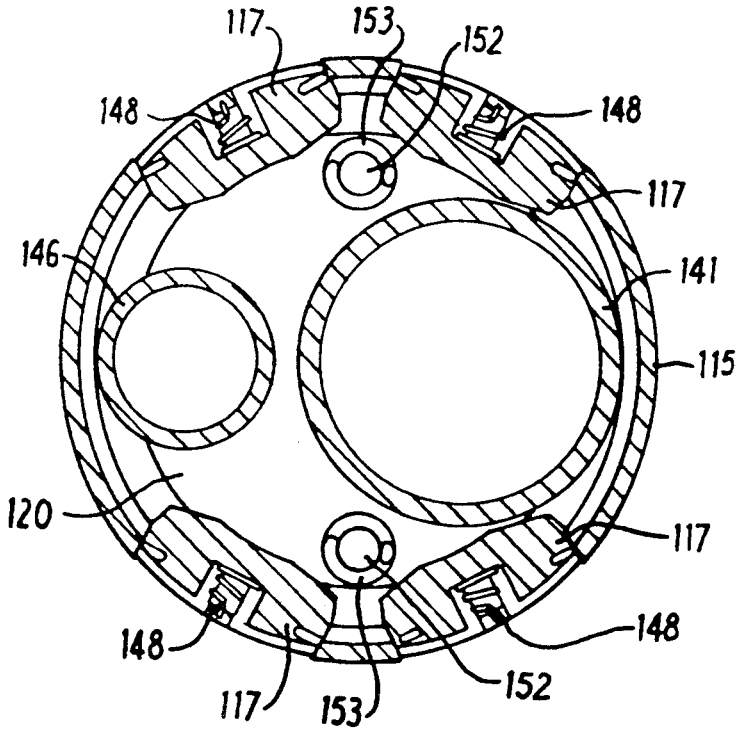
FIG. 10 is a transverse cross-section of the packer of FIG. 8, taken on the line X—X.

FIG. 10 is a transverse cross-section through the packer at the mid-height of the slips 117, and corresponding to the cross-section of the first and second embodiments shown in FIG. 3.

The previously envisaged alternative in the first embodiment to the direct mounting of the shear screws 49 in the cylinder 23 (as particularly illustrated in FIG. 2C) is adopted in the third embodiment by the provision of a separate ring 123A. The shear screws 149 (only one being visible in FIGS. 7, 8B, and 8C) are screwed into this separate ring 123A to project inwardly thereof. The ring 123A is located between the lower slip-setting cone 120 and the body lock ring 122. The ring 123A has approximately the same inside and outside diameters as the body lock ring 122. The ring 123A is attached to the upper end of the cylinder 123 by means of a resilient lock ring 123B. However, the ring 123B is not attached to the lower cone 120, nor to the body lock ring 122, nor to the piston 125. This arrangement of the separate shear-screw-mounting ring 123A is intended to allow a positive shear indication as the ring-mounted shear screws 149 are sheared when the packer is set for a second time. The upper end of the piston 125 is slidingly supported on the mandrels 141 and 146 by means of respective slide rings 170 and 171 each mounted in an external circumferential groove on the respective mandrel. The slide ring 170 is shown to an enlarged scale in an inset to FIG. 8C.

The lower end of the piston 125 is similarly slidingly supported on the bore of the cylinder 123 by means of a slide ring 172 mounted in an external circumferential groove on the piston 125, a short distance above the O-rings 126 and 126A.

Figure 8C:
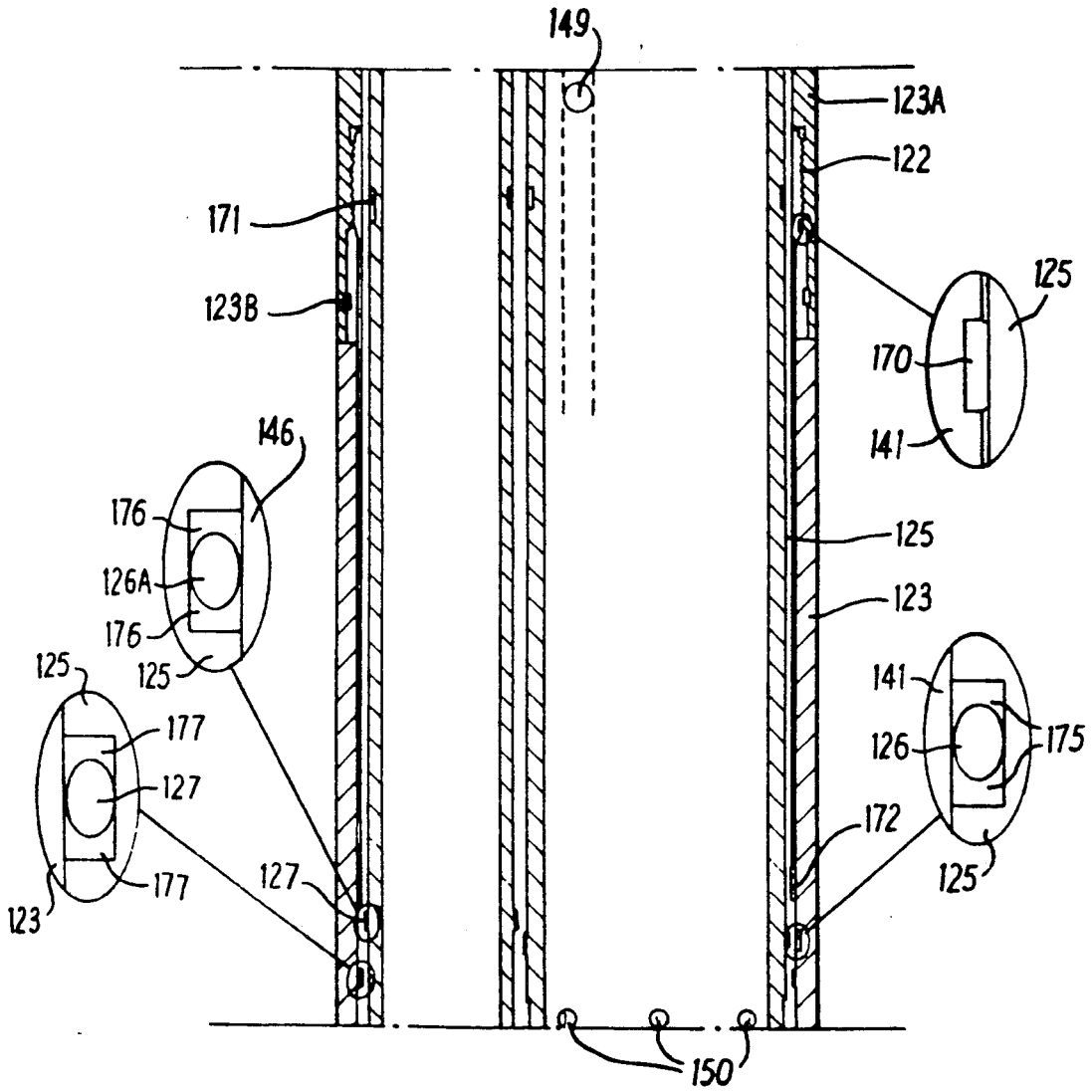

The O-rings 126, 126A, and 127 are each associated with a respective pair of back-up rings 175, 176, and 177, as shown to an enlarged scale in the various inserts to FIG. 8C. The O-rings 106, 106A, 129A, 129B, and 129C may be similarly backed-up by pairs of associated back-up rings (not shown).

The secondary piston or counter-piston 129 is slidingly supported on the bore of the cylinder 123 by means of a slide ring 179 mounted in an external circumferential groove on the secondary piston 129, a short distance below the O-rings 129A and 129B.

Figure 8D:
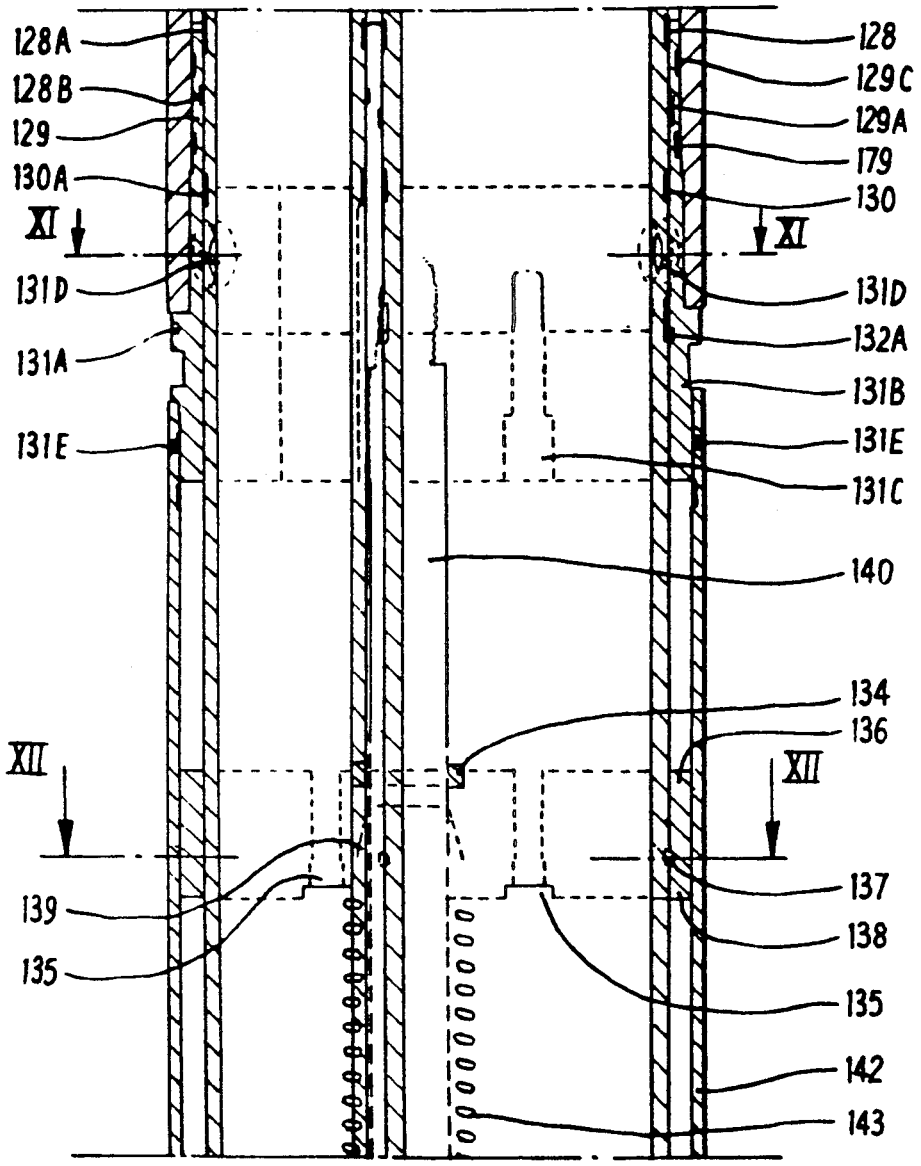
Figure 8E:
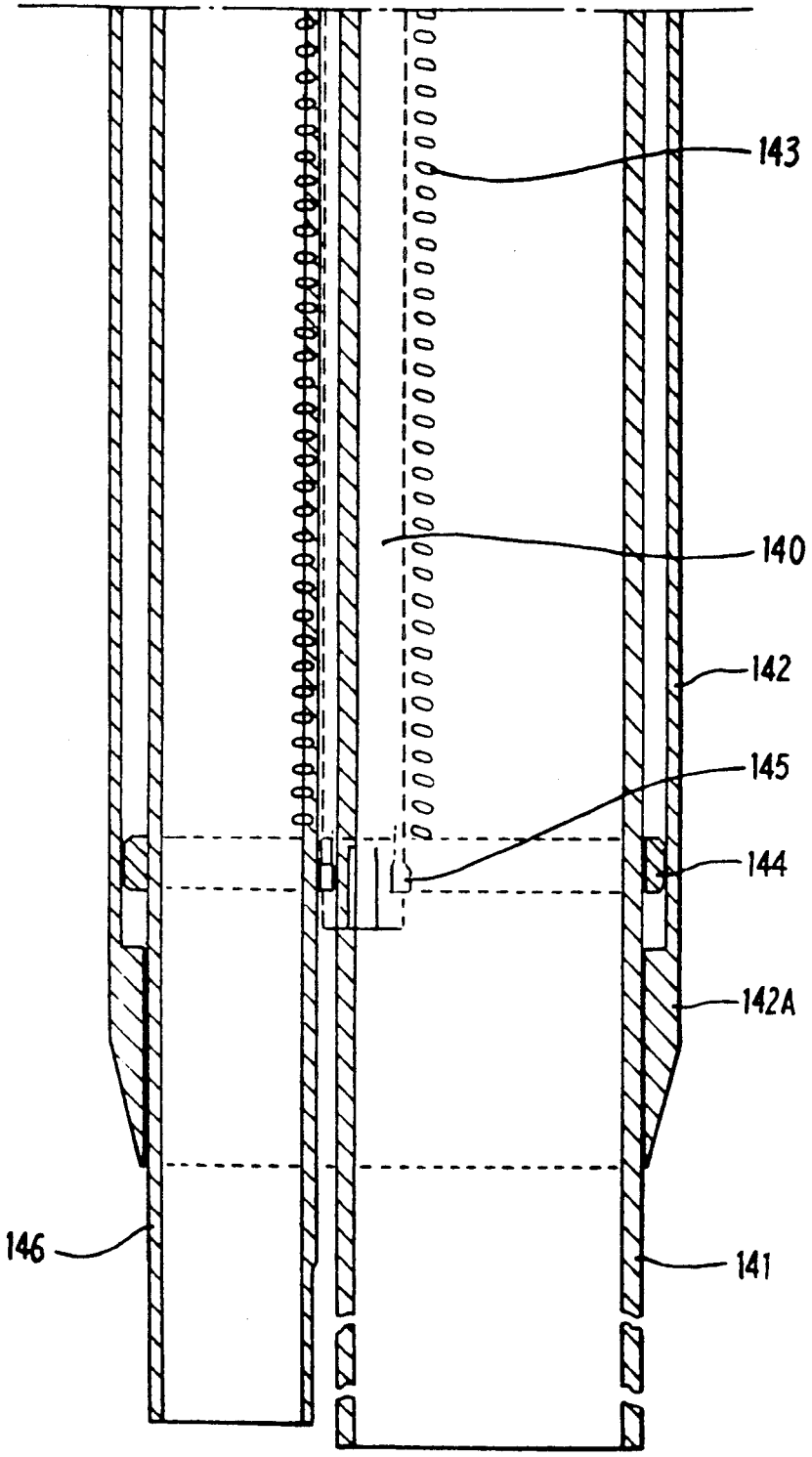
Figure 9:
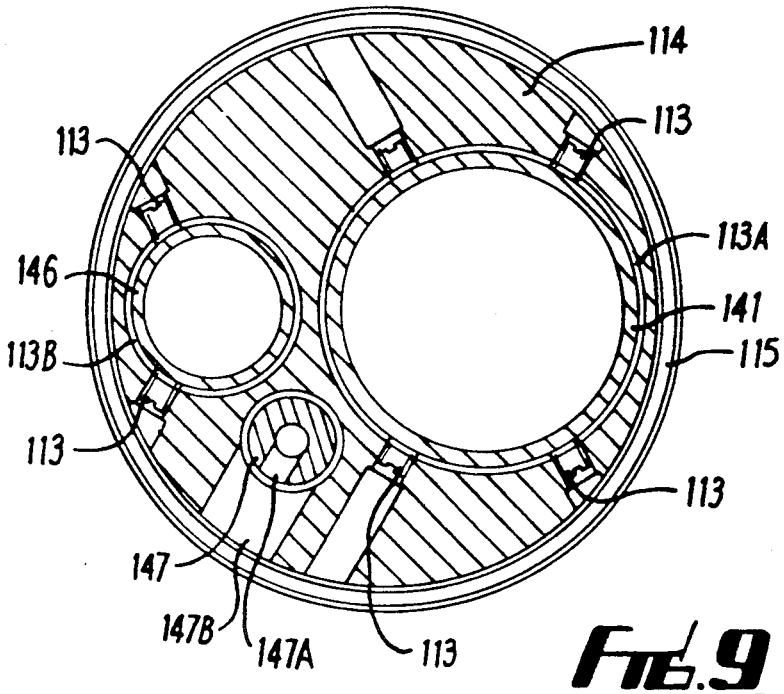
FIG. 9 is a transverse cross-section of the packer of FIG. 8, taken on the line IX—IX.

The unitary combined cylinder end member and shear plate retainer ring 31 of the first and second embodiments is replaced by an assembly comprising a cylinder end closure member 131A and a shear wire retainer 131B mutually secured by a pair of socket-head cap screws 131C (of which only one is visible in FIG. 8D). The shear plate 32 of the first and second embodiments is replaced in the third embodiment by a shear wire 132A extending circumferentially around the main mandrel 141. The circumferential extent of the shear wire 132A and its seating half in an external circumferential groove on the main mandrel 141 and half in an annular groove on the underside of the member 131A immediately surrounding the hole therethrough which accommodates the main mandrel 141 ensures secure retention of the shear wire 132A in its requisite position, thus enabling the shear plate retainer screws 33 of the first and second embodiments to be eliminated.

Figure 11:
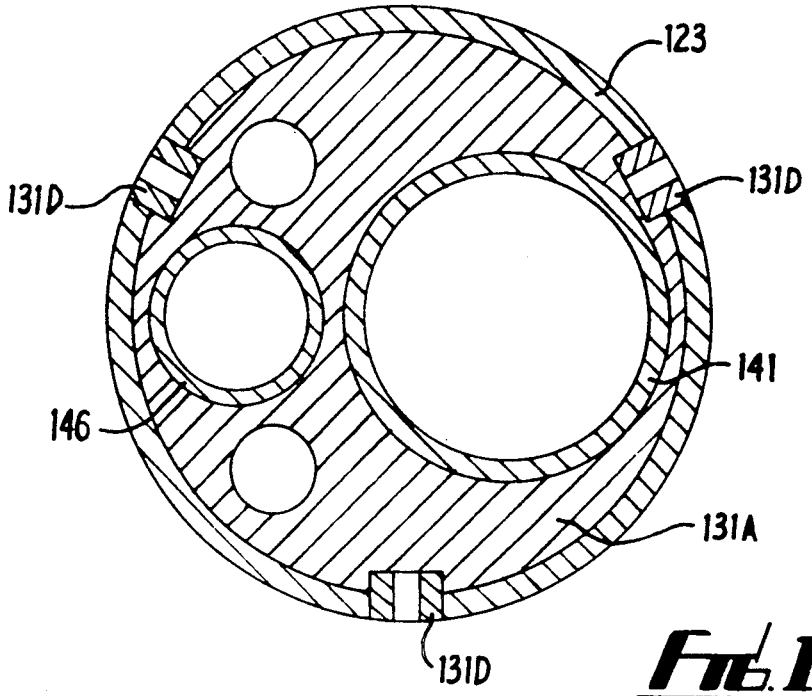
FIG. 11 is a transverse cross-section of the packer of FIG. 8, taken on the line XI—XI.

The cylinder end closure member 131A is secured to the lower end of the cylinder 123 by three equi-angularly spaced screws 131D radially penetrating both the cylinder 123 and the member 131A (FIGS. 8D and 11). The screws 131D enable elimination of the anti-rotation key-way 24 of the first and second embodiments.

The upper end of the dash-pot sleeve 142 is screwed onto the lower half of the retainer 131B (FIG. 8D), where it is locked by angularly distributed grub screws 131E. The lower end of the dash-pot sleeve 142 has a radially inwardly thickened termination 142A (FIG. 8E) which is a loose sliding fit on the mandrels 141 and 146, and holds the main extent of the sleeve 142 clear of the primer rod retainer plate 144.

Figure 12:
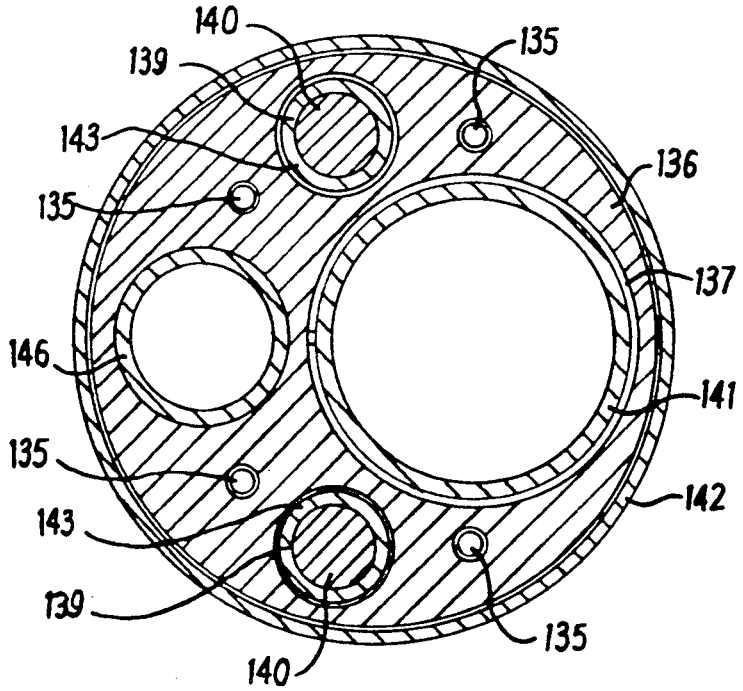
FIG. 12 is a transverse cross-section of the packer of FIG. 8, taken on the line XII—XII.
Figures 13, 14A, 14B, 14C, 14D, 14E, 14F:
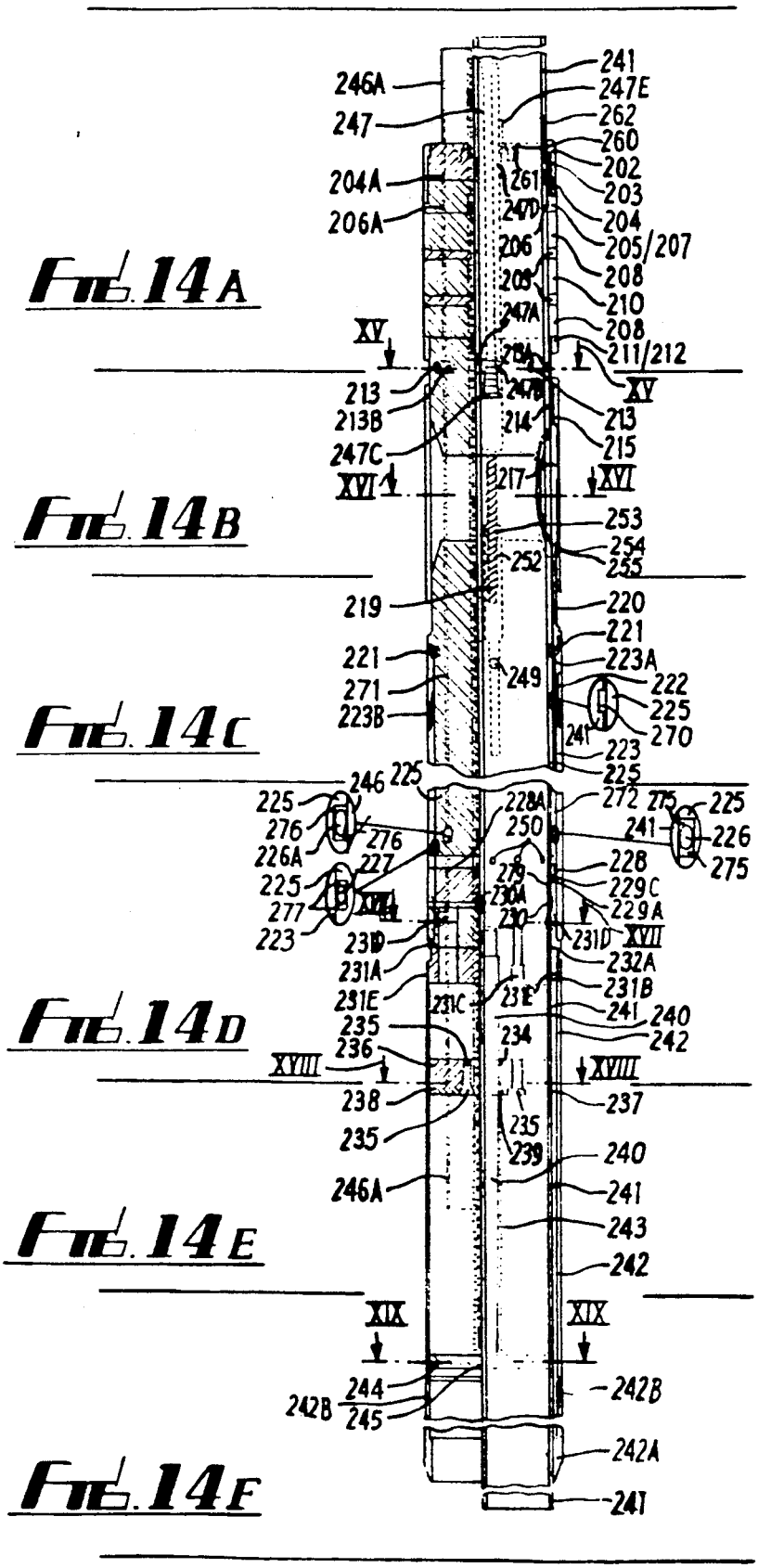
FIG. 13 is a sectional elevation of a fourth embodiment of a multi-string packer in accordance with the invention, together with indicia of the sub-division of FIG. 13 to form the components of FIG. 14.
FIGS. 14A-14F are sub-divisions of FIG. 13, to a greatly enlarged scale and fitting together as shown, in FIG. 13.
Figure 14A:
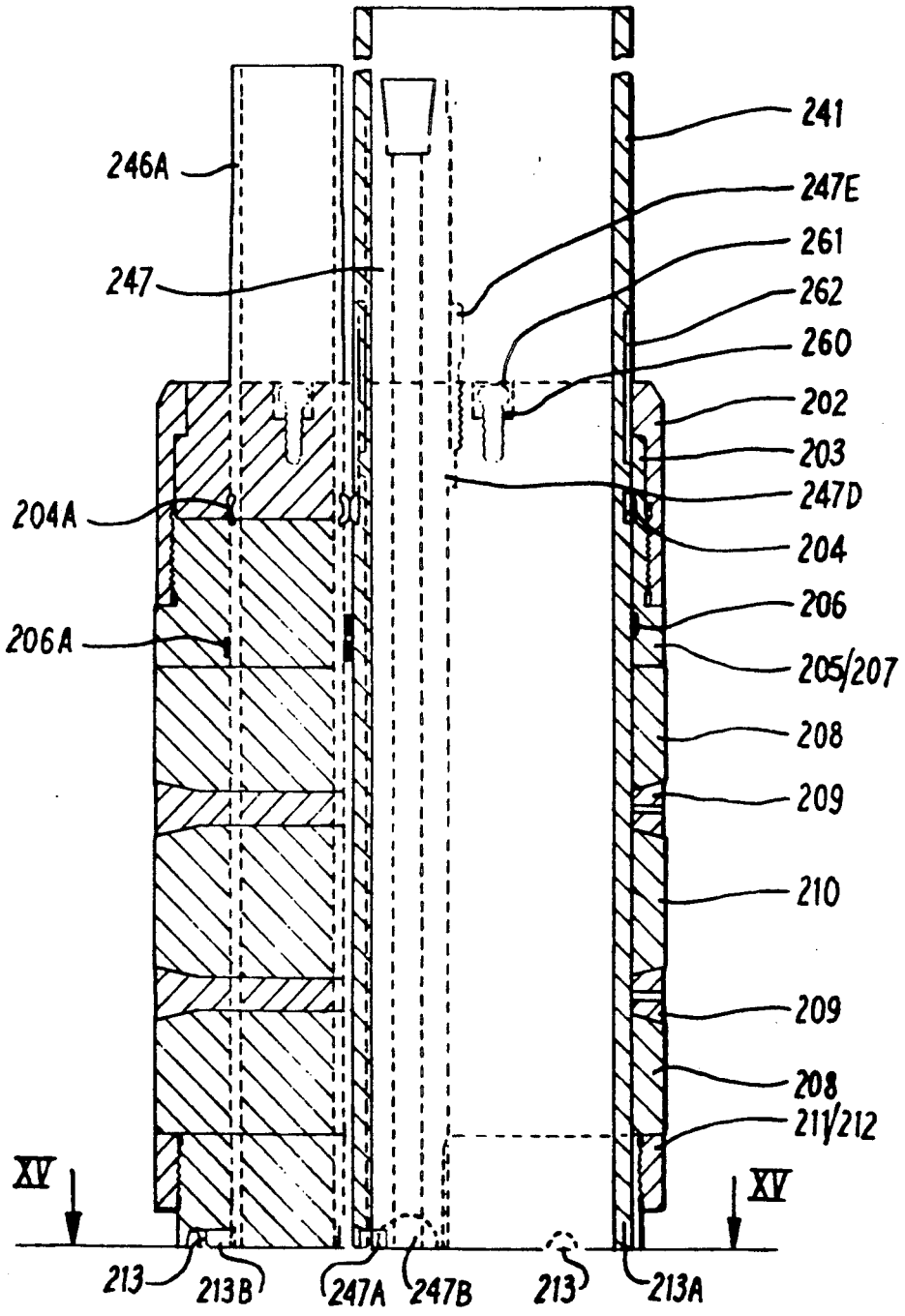
Figure 14B:
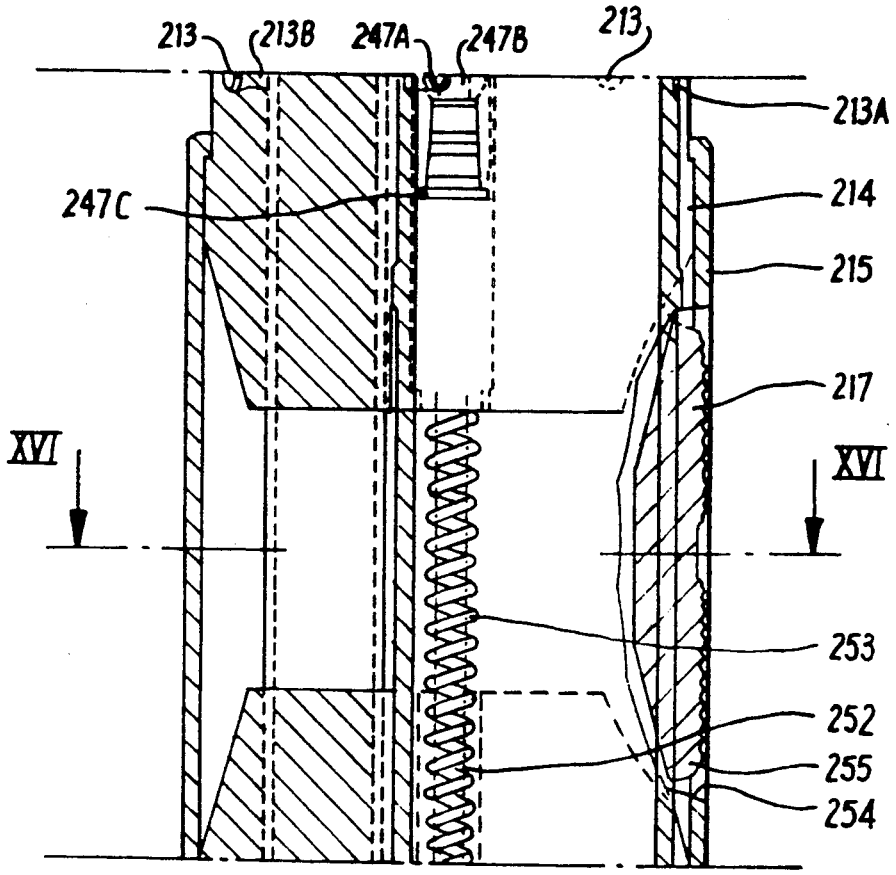
Figure 14C:
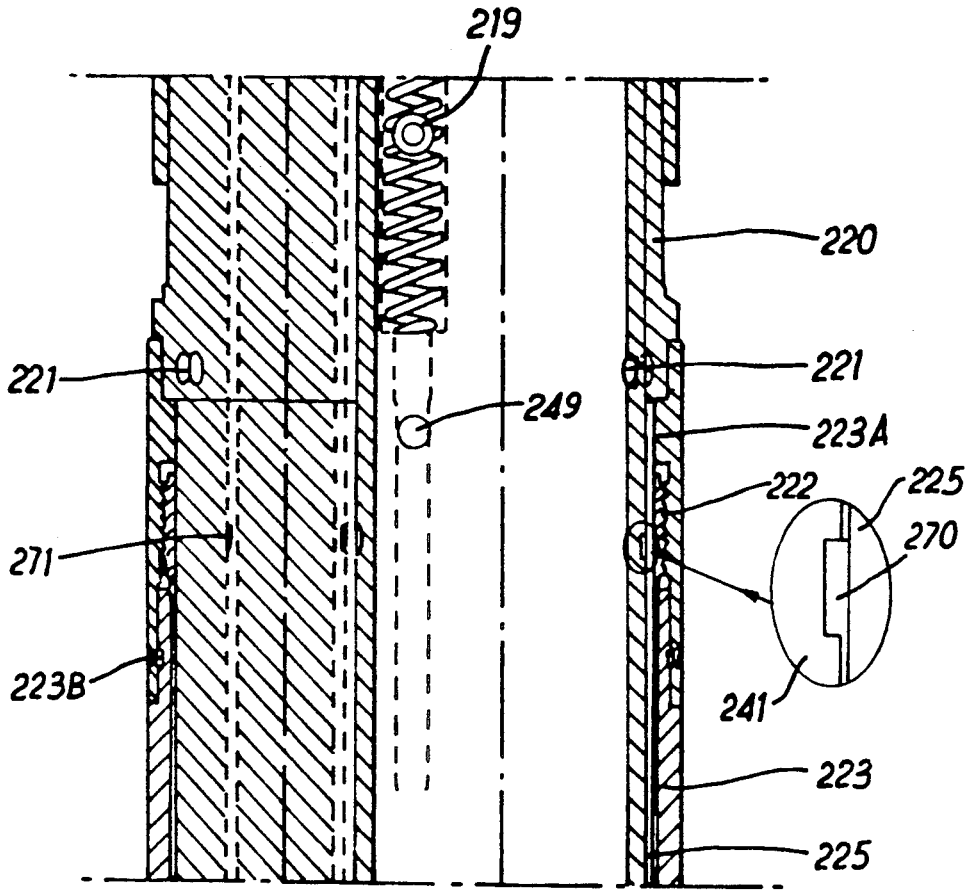
Figure 14D:
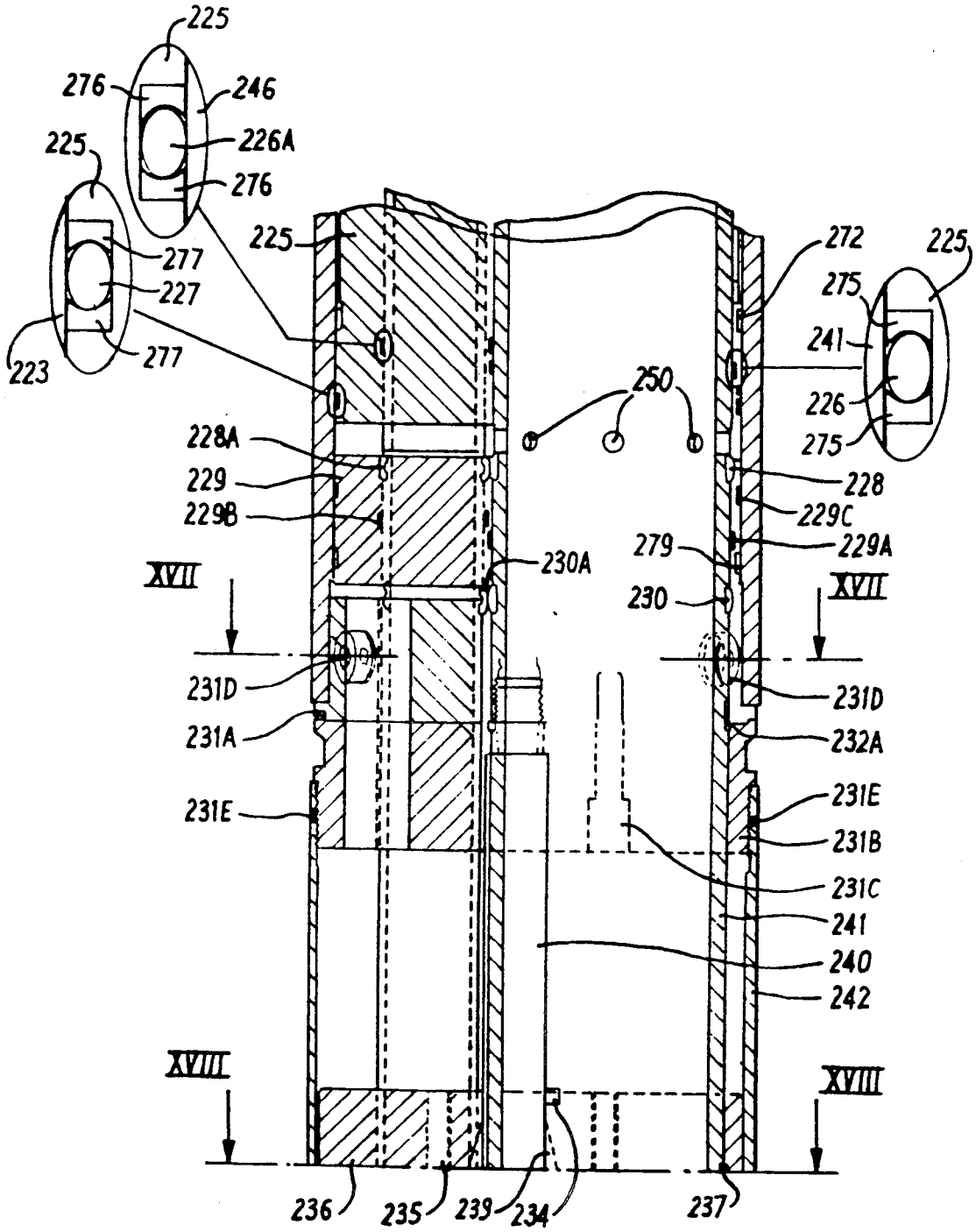
Figure 14E:
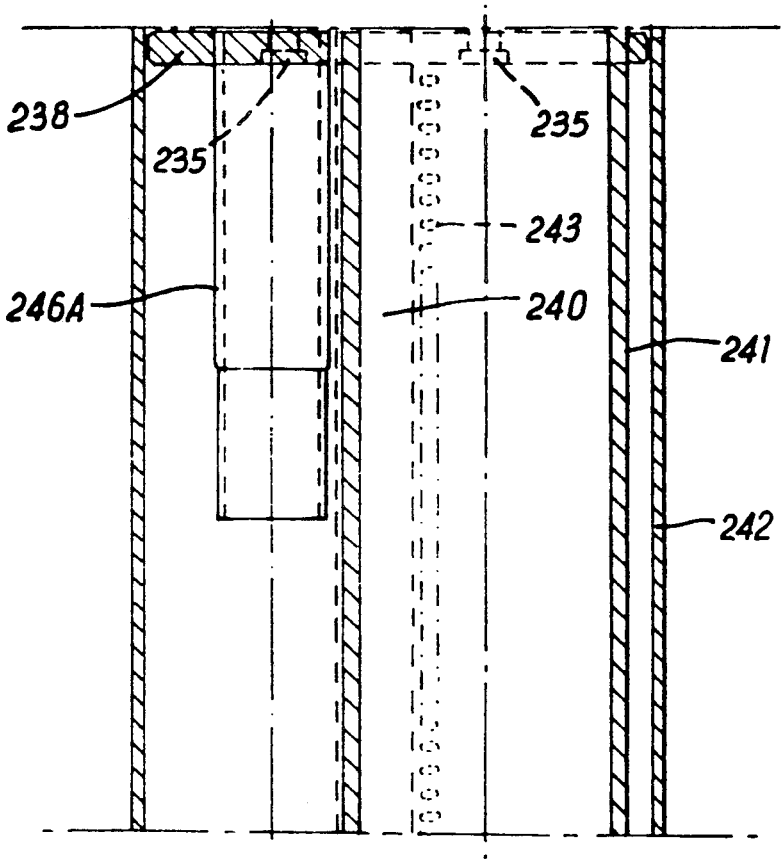
Figure 14F:
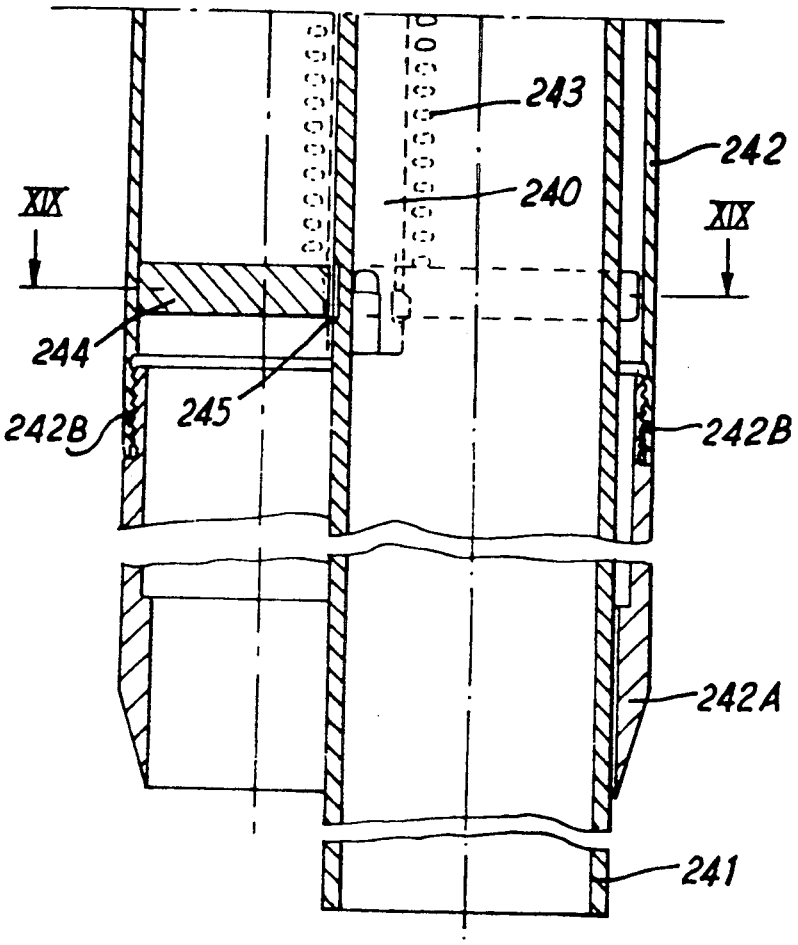
Figure 15:
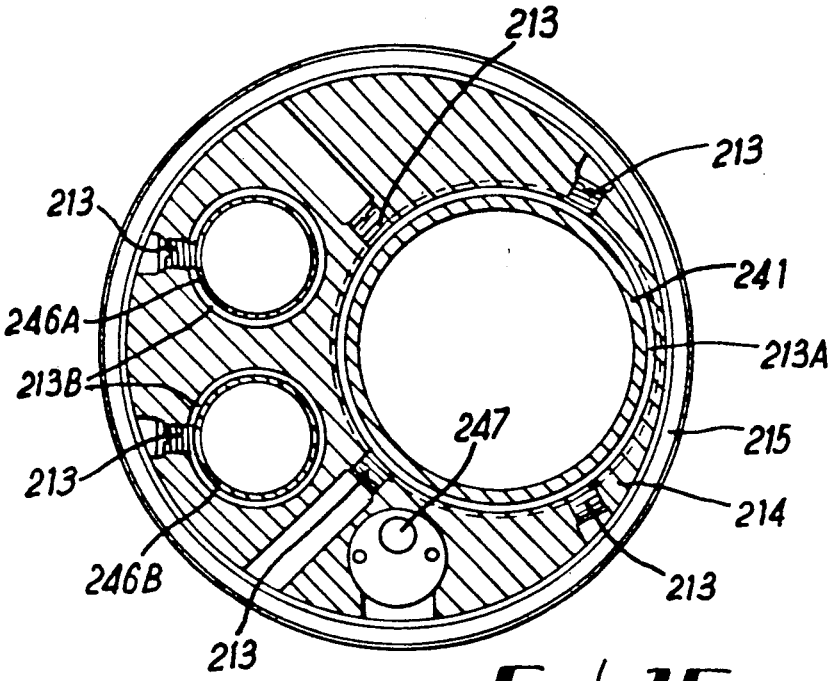
FIG. 15 is a transverse cross-section of the packer of FIG. 14, taken on the line XV—XV.
Figure 16:
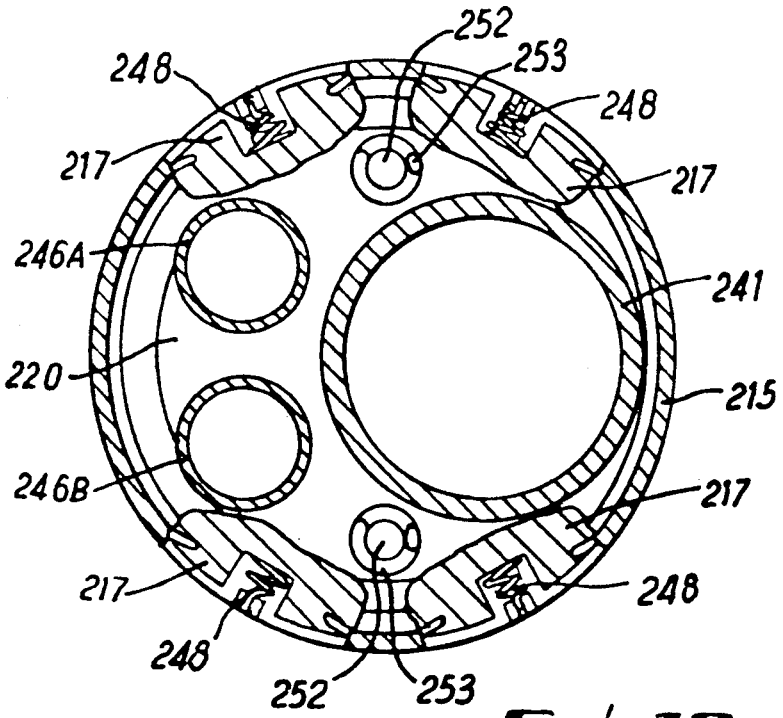
FIG. 16 is a transverse cross-section of the packer of FIG. 14, taken on the line XVI—XVI.
Figure 17:
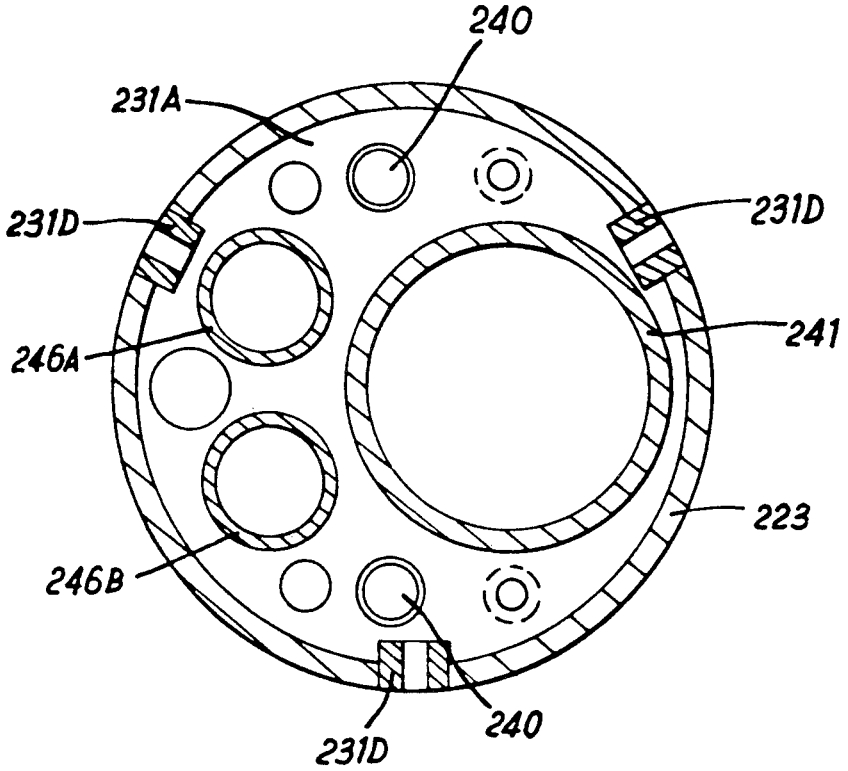
FIG. 17 is a transverse cross-section of the packer of FIG. 14, taken on the line XVII—XVII.
Figure 18:
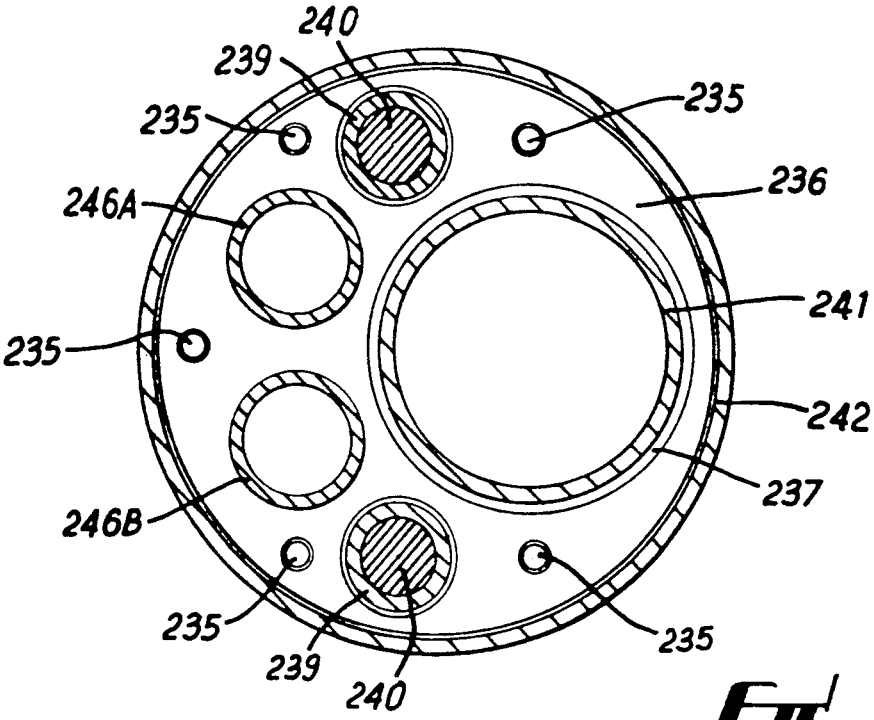
FIG. 18 is a transverse cross-section of the packer of FIG. 14, taken on the line XVIII—XVIII; and, FIG. 19 is a transverse cross-section of the packer of FIG. 14, taken on the line XIX—XIX.

The wire shear ring 137 is retained in the third embodiment for the second unsetting of the packer, and its configuration, together with its relationship to the associated components of the packer, is particularly shown in FIGS. 8D and 12.

Turning now to FIGS. 13 to 20, these illustrate a fourth embodiment of the multi-string packer in accordance with the present invention, this fourth embodiment being a dual-penetrator pump packer intended for sealing off two downhole electric pumps, each with its own power cable, and delivering pumped oil (or other fluids) to the wellhead through a common output conduit or completion tubing. Apart from the provision of two penetrator mandrels (denoted 246A and 246B), the fourth embodiment is structurally and functionally essentially similar to the third embodiment (which, in turn, is essentially similar to the first and/or second embodiments except for the detail differences described above). Those parts of the fourth embodiment which are not structurally or functionally substantially different from corresponding parts of the third embodiment are given the same reference numerals as are employed in the foregoing description of the third embodiment, except that the leading digit "1" of each reference numeral is replaced by a "2". Accordingly, for a full description of any part of the fourth embodiment not detailed below, reference should be made to the above description of the corresponding parts of the third embodiment, and in turn (where necessary) to the above description of the corresponding parts of the first and/or second embodiments. Since the fourth embodiment is largely the same as the third embodiment (except for the duplication of the penetrator mandrels), the following description of the fourth embodiment will concentrate mainly on those parts of the fourth embodiment which differ from the third embodiment.

The fourth embodiment (FIGS. 13 to 19) differs mainly from the third embodiment (FIGS. 7 to 12) in the provision of two (rather than one) through tubes or mandrels 246A and 246B (compare with the single mandrel 146 of the third embodiment) each intended to pass a respective pump power supply cable sealed thereto by a respective penetrator. Only the penetrator-passing mandrel 246A is visible in FIGS. 7 to 8F, but both of these penetrator-passing mandrels 246A and 246B are visible in the transverse cross-sections depicted in FIGS. 15, 16, 17, and 18.

Figure 19:
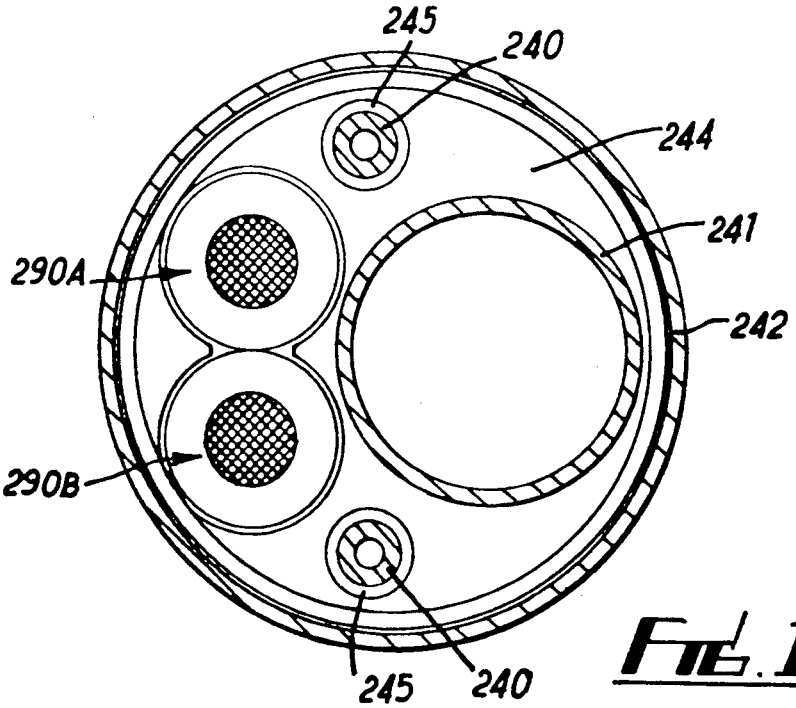

The respective penetrators 290A and 290B and the respective enclosed circular power cables are schematically depicted in FIG. 19. Securing of the penetrator 290A and 290B at the lower ends of the respective mandrels 246A and 246B allows the inside diameters of these mandrels to be significantly larger than in conventional prior-art multi-string packers wherein the penetrators are secured at the tops of the mandrels. Thus the fourth embodiment of multi-string packer in accordance with the present invention enables the packing of two heavy-duty round power cables with an outside diameter of 1.5 inches (38.1 millimeters) in conjunction with bottom-secured penetrators having an outside diameter of 2 inches (50.8 millimeters). In turn, this enables the main mandrel 241 to have an outside diameter of 4.5 inches (114.3 millimeters) and so avoids the restriction on completion tubing bore necessitated by prior art packers having top-secured penetrators.

Conversely, in gas-vented packers which are set high in the well, one of the dual short-string mandrels (246A or 246B) with an inside diameter of 1.562 inches (39.7 millimeters) can be employed to vent the maximum quantities of well gas with a minimum pressure drop, and still maintain a 4.5 inches outside diameter main mandrel 241 for completion from a single pump. In prior art gas-venting single-pump packers, the retention of a 4.5 inch outside diameter main mandrel necessitates a gas-venting mandrel having an inside diameter restricted to 1 inch (25.4 millimeters). Thus the present invention offers functional advantages in terms of avoiding conventional bore restrictions in prior art multi-string packers, as well as avoiding the conventional necessity of withdrawal from the well after a single unsetting of the packer.

In the single-penetrator embodiments of the present invention, similar bore-restriction-avoiding advantages are possible by securing the penetrator at the lower end of the short string mandrel.

Other than the duplication of short-string mandrels and concomitant layout changes, the substantive structural difference of the fourth embodiment compared to the third embodiment consists of the lower end 242A of the dash-pot sleeve 242 being formed as a separate component (FIG. 14F; compare with FIG. 8E), the sleeve end component 242A being secured to the lower end of the sleeve 242 by a screw-thread connection and locked by means of radially penetrating grub screws 242B.

In respect of setting, unsetting, and resetting operations, the fourth embodiment functions in the manner described in respect of the third embodiment (related as previously described to the first and second embodiments).

While certain modifications and variations have been described above, the invention is not restricted thereto, and other modifications and variations can be adopted without departing from the scope of the invention as defined in the appended claims.

I claim:

1. A multi-string packer for selectively anchoring at least two through tubes to an inside diameter of a larger-diameter pipe or casing, said packer being resettable at least once without being withdrawn from a well in which said larger-diameter pipe or casing is installed, said packer comprising a first through tube and at least one further through tube, slips for setting said packer to anchor said packer to said inside diameter of said larger-diameter pipe or casing, slip actuator means for selectively either laterally advancing said slips to packer-anchoring laterally extended positions contacting said inside diameter and in which said packer is set, or permitting said slips to retract laterally to non-anchoring laterally retracted positions free of said inside diameter and in which said packer is unset, said packer further comprising first, second and third shear means, said slip actuator means being actuable on a first occasion by shearing of said first shear means to advance said slips laterally to said packer-anchoring laterally extended positions contacting said inside diameter for a first setting of said packer upon such actuation, said slip actuator means being subsequently actuable on a second occasion by shearing of said second shear means to permit said slips to retract laterally to said non-anchoring laterally retracted positions free of said inside diameter for a first unsetting of said packer upon such actuation, and said slip actuator means being subsequently actuable on a third occasion by shearing of said third shear means to re-advance said slips laterally to said packer-anchoring laterally extended positions contacting said inside diameter for a first resetting of said packer, said packer additionally comprising first lost-motion means through which said shearing of said third shear means upon said third occasion is accomplished, said first lost-motion means preventing shearing of said third shear means upon said first occasion.

2. A multi-string packer as claimed in claim 1, wherein said packer comprises a peripheral seal which is laterally expandable concomitantly with said actuation of said slip actuator means on said first and third occasions such as to provide substantially pressure-tight sealing of the packer to the inside diameter of the larger pipe or casing.

3. A multi-string packer as claimed in claim 2, wherein said peripheral seal is also contractible out of contact with the inside diameter of the larger pipe or casing concomitantly with said actuation of said slip actuator means on said second occasion.

4. A multi-string packer as claimed in claim 1, wherein said packer comprises hydraulic actuator means coupled to said slip actuator means to cause hydraulic actuation of said slip actuator means on said first and third occasions.

5. A multi-string packer as claimed in claim 4, wherein said hydraulic actuator means comprises a hydraulic piston movable under hydraulic pressure to cause said hydraulic actuation of said slip actuator means.

6. A multi-string packer as claimed in claim 5, wherein hydraulic actuator means further comprises a hydraulic cylinder, and wherein said hydraulic piston is movable in said hydraulic cylinder.

7. A multi-string packer as claimed in claim 6, wherein said hydraulic cylinder communicates by way of a passage to the interior of said first through tube whereby hydraulic pressurisation of said first through tube causes said hydraulic actuation of said slip actuator means.

8. A multi-string packer as claimed in claim 7, wherein said first shear means comprises at least one shear element directly linking said piston with said cylinder until said first occasion, and said third shear means comprises at least one shear element which is directly attached to said hydraulic cylinder to depend into a longitudinal slot in said hydraulic piston, said longitudinal slot being comprised in said first lost-motion means and having a length generally defining the extent of lost motion of said first lost-motion means.

9. A multi-string packer as claimed in claim 1, wherein said packer comprises mechanical actuator means coupled to said slip actuator means to cause mechanical actuation of said slip actuator means on said second occasion.

10. A multi-string packer as claimed in claim 9, wherein said slip actuator means is mechanically coupled to said first through tube such that a substantial lift force applied to said first through tube causes said mechanical actuation of said slip actuator means, and said second shear means links said first through tube to said slip actuator means such that said substantial lift force shears said second shear means on said second occasion.

11. A multi-string packer as claimed in claim 10, wherein said packer further comprises a fourth shear means, and said slip actuator means is subsequently mechanically actuable on a fourth occasion by shearing of said fourth shear means to permit the slips to retract laterally to said non-anchoring laterally retracted positions free of said inside diameter for a second unsetting of the packer, with said packer further comprising second lost-motion means through which shearing of said fourth shear means upon said fourth occasion is accomplished, said second lost-motion means preventing shearing of said fourth shear means upon said second occasion.

12. A multi-string packer as claimed in claim 11, wherein said second lost-motion means comprises spring-biased slide means initially anchored at a first end through said second shear means to said first through tube and initially anchored at a second end through said fourth shear means to said first through tube, the initial anchored locations of said first and second ends being mutually separated along said first through tube and the spring biasing of said slide means being such as to tend to reduce the initial separation of said first and second ends, said second lost-motion means being such that shearing of said second shear means on said second occasion releases said first end of said spring-biased slide means for movement by said spring bias to abut said second end of said spring-biased slide means and render said fourth shear means shearable on said fourth occasion, the extent of movement of said first end from its initially anchored position to abutment with said second end constituting the lost motion of said second lost-motion means.

13. A multi-string packer as claimed in claim 12, wherein said spring-biased slide means incorporates latch means effective upon abutment of said first end with said second end to latch said first end in abutment with said second end.

14. A multi-string packer as claimed in claim 13, wherein said latch means comprises a ratcheting collet.

15. A multi-string packer as claimed in claim 12, wherein said movement of said first end of said spring-biased slide means by said spring bias is damped by a hydraulic dash-pot comprised within said packer.

16. A multi-string packer as claimed in claim 15, wherein an elastomeric shock absorber is interposed between said first and second ends.

* * * * *